US010669726B2

(12) United States Patent
Murray et al.

(10) Patent No.: US 10,669,726 B2
(45) Date of Patent: Jun. 2, 2020

(54) SYSTEM FOR APPLYING FINISHING COMPOUND

(71) Applicant: Level 5 Tools, LLC, Kansas City, KS (US)

(72) Inventors: Scott A. Murray, Kansas City, KS (US); Sun Xiaowei, Yongkang (CN)

(73) Assignee: Level 5 Tools, LLC, Kansas City, KS (US)

( * ) Notice: Subject to any disclaimer, the term of this patent is extended or adjusted under 35 U.S.C. 154(b) by 0 days.

(21) Appl. No.: 16/045,244

(22) Filed: Jul. 25, 2018

(65) Prior Publication Data

US 2018/0328052 A1 Nov. 15, 2018

Related U.S. Application Data

(63) Continuation-in-part of application No. 15/721,601, filed on Sep. 29, 2017.

(60) Provisional application No. 62/401,579, filed on Sep. 29, 2016.

(51) Int. Cl.

| | |
|---|---|
| ***E04F 21/12*** | (2006.01) |
| ***E04F 21/02*** | (2006.01) |
| ***E04F 21/165*** | (2006.01) |
| *B05C 17/005* | (2006.01) |
| *B05C 17/01* | (2006.01) |

(52) U.S. Cl.

CPC ..... *E04F 21/026* (2013.01); *E04F 21/12* (2013.01); *E04F 21/1655* (2013.01); *B05C 17/0052* (2013.01); *B05C 17/00516* (2013.01); *B05C 17/0103* (2013.01)

(58) Field of Classification Search

CPC ..... E04F 21/026; E04F 21/12; E04F 21/1655
USPC ..... 401/148, 171–182, 188 R, 188 A, 272
See application file for complete search history.

(56) References Cited

U.S. PATENT DOCUMENTS

| | | | |
|---|---|---|---|
| 4,986,475 | A | 1/1991 | Spadafora et al. |
| 5,882,691 | A | 3/1999 | Conboy |
| 5,902,451 | A | 5/1999 | O'Mara et al. |
| 5,953,799 | A | 9/1999 | Panaccione et al. |
| 6,260,238 | B1 | 7/2001 | MacMillan |
| 6,473,939 | B1 | 11/2002 | Stegmaier |
| 6,581,805 | B2 | 6/2003 | Conboy et al. |
| 6,726,868 | B1 | 4/2004 | Panfili et al. |

(Continued)

*Primary Examiner* — David J Walczak
*Assistant Examiner* — Joshua R Wiljanen
(74) *Attorney, Agent, or Firm* — Law Office of Mark Brown, LLC; Ryan S. Hinderliter; Mark E. Brown

(57) ABSTRACT

A system for finishing surfaces with a finishing material includes a handle assembly with proximal and distal ends. A material reservoir is mounted on the handle distal and includes an inlet and an outlet. A material applicator tool is mounted on the reservoir and receives material from the reservoir outlet. A discharge mechanism includes an extendable-retractable component or linear actuator connected to the reservoir for discharging or reloading material. An alternative embodiment includes a lockable, compressible gas spring. Another alternative embodiment includes a rotating element driven by a reversible motor mounted on the handle assembly. The rotating element drives a discharge mechanism in a discharge direction of rotation, and reloads the reservoir in a reload direction of rotation. Multiple alternative embodiments of linear actuators are disclosed. An alternative embodiment includes a push-to-open valve mechanism.

19 Claims, 35 Drawing Sheets

(56) References Cited

U.S. PATENT DOCUMENTS

| | | | | |
|---|---|---|---|---|
| 6,742,215 | B2 | 6/2004 | Panfili et al. | |
| 6,793,428 | B2 | 9/2004 | Lithgow | |
| D508,638 | S | 8/2005 | Meyer et al. | |
| 7,114,869 | B2 | 10/2006 | MacMillan | |
| D541,616 | S | 5/2007 | Bruno et al. | |
| D545,168 | S | 6/2007 | Rudder | |
| D549,070 | S | 8/2007 | Bruno et al. | |
| D551,053 | S | 9/2007 | Bruno et al. | |
| D553,939 | S | 10/2007 | Bruno et al. | |
| D553,941 | S | 10/2007 | Bruno et al. | |
| D564,383 | S | 4/2008 | Bruno et al. | |
| D565,921 | S | 4/2008 | Bruno et al. | |
| 7,434,318 | B2 | 10/2008 | Perez et al. | |
| 7,458,127 | B2 | 12/2008 | Bruno et al. | |
| D584,126 | S | 1/2009 | Meyer | |
| 7,556,447 | B2 | 7/2009 | Bruggeman et al. | |
| D614,471 | S | 4/2010 | Meyer et al. | |
| 7,775,736 | B2 * | 8/2010 | Song | A46B 11/0013 401/137 |
| 8,381,789 | B2 | 2/2013 | Payne | |
| 8,517,077 | B2 | 8/2013 | Payne | |
| 8,747,006 | B2 | 6/2014 | Payne | |
| 9,051,744 | B1 | 6/2015 | Murray et al. | |
| 9,283,586 | B2 | 3/2016 | MacMillan | |
| D838,159 | S | 1/2019 | Jimenez et al. | |
| 2001/0003563 | A1 | 6/2001 | Schauer et al. | |
| 2010/0260530 | A1 | 10/2010 | Schlecht et al. | |
| 2011/0020050 | A1 | 1/2011 | Sandahl et al. | |
| 2015/0328607 | A1 | 11/2015 | Wittbold et al. | |
| 2016/0121287 | A1 | 5/2016 | Brown et al. | |
| 2017/0065950 | A1 | 3/2017 | Schenck et al. | |
| 2018/0087281 | A1 | 3/2018 | Murray | |

* cited by examiner

1. CLOSES THROTTLE VALVE

2a. SQUEEZES (AND LATCHES) TRIGGER TO INNER POSITION

2b. DEPRESSES (AND HOLDS) ACTUATOR BUTTON (aka RELEASE PIN)

3. ACTUATES PRESSURIZED CYLINDER FOR RETRACTION

4a. CHARGES RESERVOIR WITH MUD

4b. FORCES CYLINDER TO RETRACT

CROSS SECTION — CLOSED

CLOSED

CROSS SECTION – CLOSED

CLOSED

CROSS SECTION – OPEN

OPEN

CROSS SECTION – OPEN

OPEN

SYSTEM FOR APPLYING FINISHING COMPOUND

CROSS-REFERENCE TO RELATED APPLICATIONS

Continuation-in-part of U.S. patent application Ser. No. 15/721,601, filed Sep. 29, 2017, which claims priority in U.S. Provisional Patent Application No. 62/401,579, filed Sep. 29, 2016, which are incorporated herein by reference.

BACKGROUND OF THE INVENTION

1. Field of the Invention

The present invention relates generally to: tools, equipment, and related devices that dispense semi-fluid compounds; procedures for using same; and in particular to an applicator system for finishing drywall and other surfaces.

2. Description of the Related Art

Drywall installation typically involves joining two or more panels or sheets of gypsum board together to create a larger surface, such as a wall or ceiling. This is accomplished by taping the joints and covering the tape with joint compound (or "mud"). Additional applications of mud can be used depending on the specified level of surface finish. Some drywall finishers prefer to apply the mud by hand using putty knives, but this can be a time-consuming process. To semi-automate the process, tool manufacturers have created "flat boxes" comprising reservoirs attached to handles for guiding along gypsum board or drywall joints. The flat boxes apply joint compound, normally over a strip of joint tape, along joints. The joint compound can be sanded and re-coated as necessary to achieve the specified finish level. There are also corner tools and associated reservoirs that apply mud to corner joints. The user applies pressure via a handle assembly to dispense the mud while pushing or pulling such applicators along the drywall joints.

Previous drywall finishing tools include the Continuous Flow Paste Applicator for Dry Wall shown in U.S. Patent Publication No. 2001/0003563, but the connected hoses required by this applicator can be unwieldy. Other prior art finishing systems include components that must be carried around with handle systems, e.g., as shown in U.S. Pat. No. 6,793,428 for Drywall Joint Compound Applicator Appliance, or that continuously dispense compound until a brake is applied, which can lead to the tool dispensing excess compound.

The embodiments of the present invention address prior art deficiencies with systems and methods for applying compound to work surfaces efficiently and effectively. Finishing operations are thus simplified, resulting in higher quality results in less time and with less expense.

Heretofore, there has not been available a surface finishing system with the features and advantages of the present invention.

SUMMARY OF THE INVENTION

In practicing an aspect of the present invention, a system is provided for automatically applying a finishing compound to a surface, e.g., joint compound ("mud"), which can be applied over joint tape to form a flush or level drywall joint. Modified or alternative aspects of the invention include lockable gas springs, piston-and-cylinder units and drive augers for dispensing the compound from a handle assembly, which can be held by an operator. Power can be applied via compressed springs extending a plunger or electric motors rotating an auger. Various application-specific finishing tools, such as mud knives for flat surfaces and corner tools (e.g., for wall-ceiling and wall-wall intersections), can be mounted on the handle assembly. In practicing another aspect of the present invention, a finishing compound applicator includes a dispensing valve activated by engaging the applicator with a wall surface, whereupon compound is automatically dispensed under pressure until the applicator disengages. In this embodiment the operator merely loads or charges the applicator with compound, engages the work surface (e.g., a wall and/or ceiling), and disengages to halt compound flow.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of movement, if appropriate. Said terminology will include the words specifically mentioned, derivatives thereof and words of similar meaning.

II. First Modified Embodiment or Alternative Aspect of the Invention (FIGS. 1-5)

Figure 5:
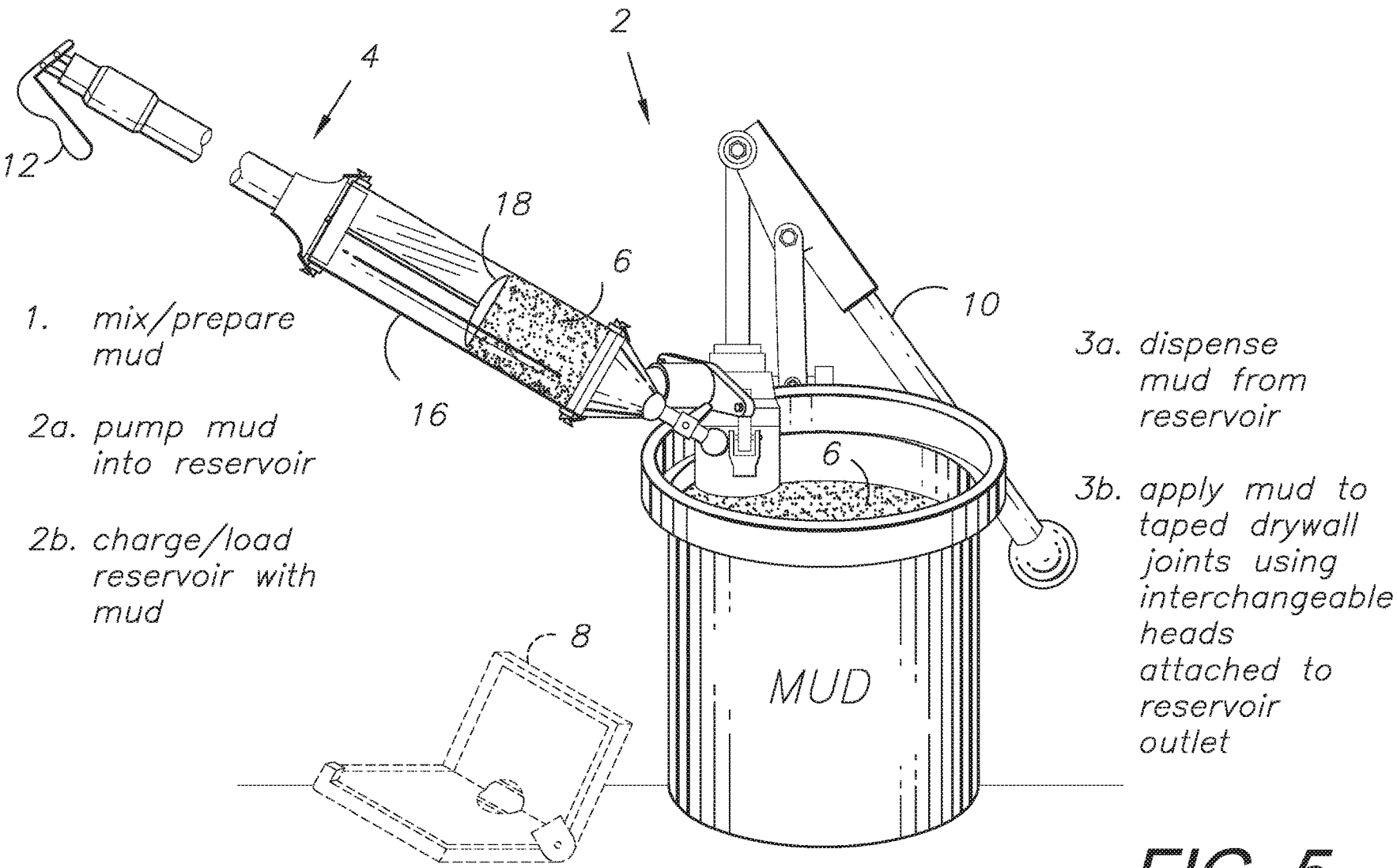
FIG. 5 shows the finishing system, including a dispensing tool thereof, a container of compound, a compound pump and a corner application attachment.
Figure 6:
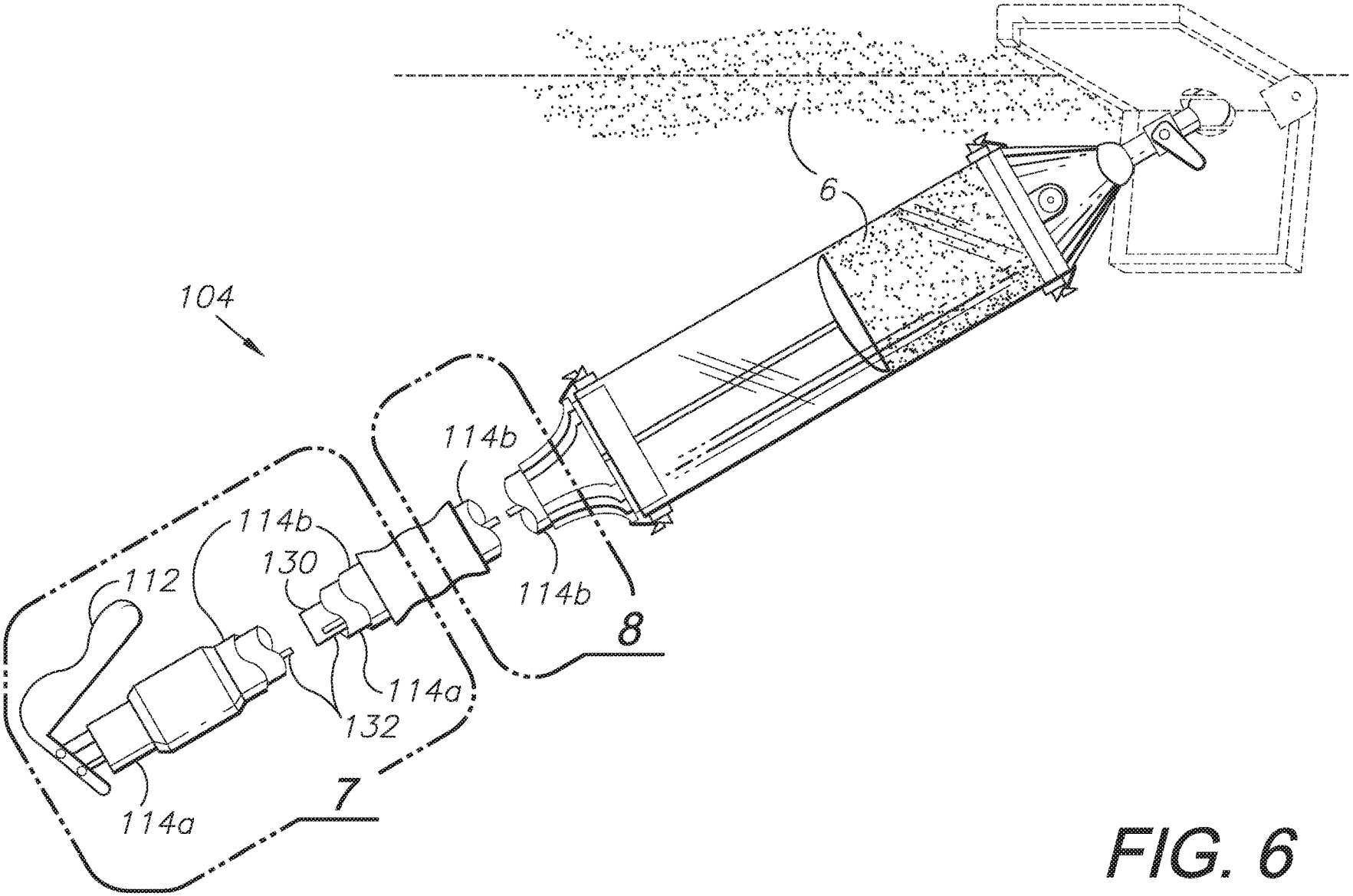
FIG. 6 shows a surface finishing system comprising an alternative or modified aspect of the present invention, shown in use finishing a ceiling-wall joint.
Figure 7:
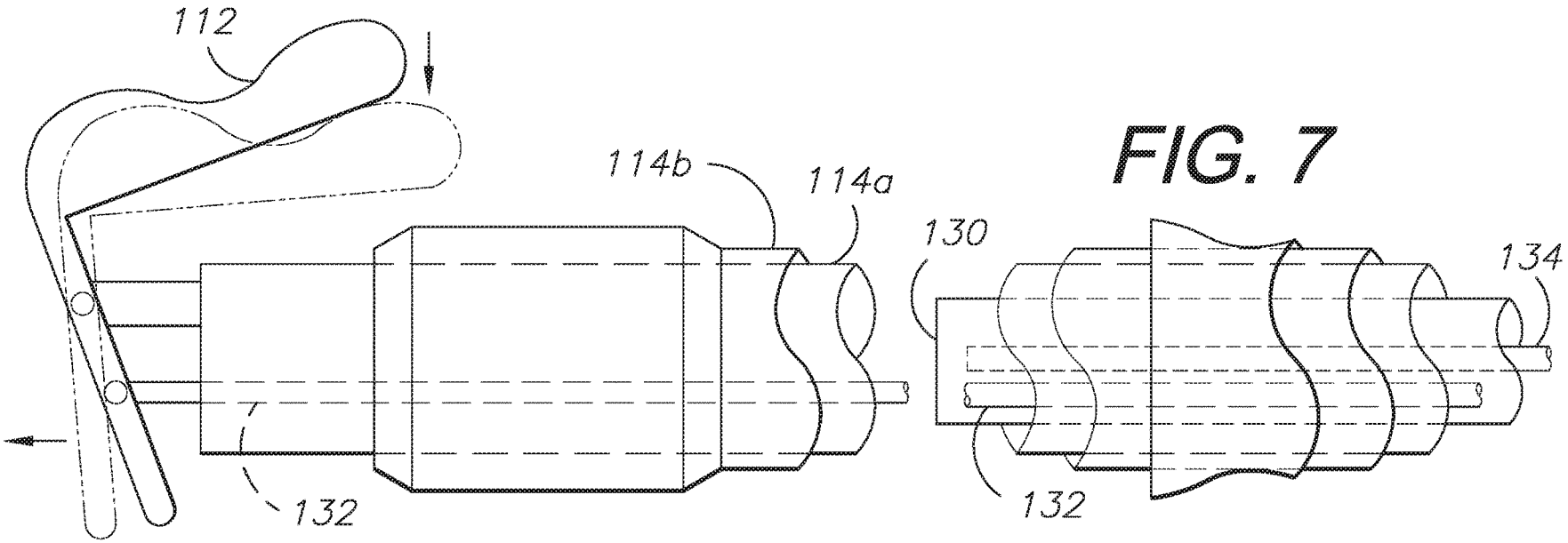
FIG. 7 is an enlarged, fragmentary view thereof, taken generally within area 7 in FIG. 6.
Figure 9:
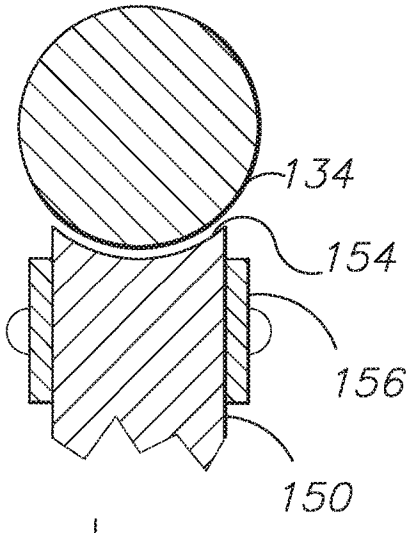
FIG. 9 is a cross-sectional view thereof taken generally along line 9-9 in FIG. 8A and particularly showing a cam surface engagement with a slave rod.

Referring to FIGS. 1-5, a compound application or surface finishing system 2 employs a compound-dispensing tool 4 to apply a quantity of material 6, such as drywall finishing compound or "mud", to some other material or surface 7, such as taped drywall joints. The compound 6 can be applied using a removable, interchangeable application tool 8 (e.g., a drywall compound distribution box) attached to a reservoir 16 outlet, said reservoir 16 capable of containing an amount of compound 6. In an embodiment of the application system 2 a pump 10 is used to move compound 6 from a source (e.g., a finishing compound bucket as shown in FIG. 5) and into the reservoir 16 via a fill access port 22 for reloading or recharging the reservoir 16 as the material 6 is applied and used. A plunger 18 can be employed to push and dispense the material 6 out of the reservoir 16. An embodiment of the invention can also include a ball throttle valve 24 to control dispensing the compound 6 from the reservoir 16. Part of the compound-dispensing assembly 4 of the invention can also include one or more openable clamp assemblies 20 for ease of removing the reservoir from a handle 14 in order to access, open, or dismantle the assembled tool for cleaning, storage, or for any other reason.

A handle 14 can extend the distance between a user and the intended application surface 7. Various embodiments of certain features of the invention can also be mounted onto or in the handle 14.

The extendable-retractable handle 14 can include one or more sections 14*a*, 14*b*, etc., which can telescope with respect to each other. A pressurized cylinder 30 can be mounted in the handle 14 for dispensing a quantity of material 6, such as drywall finishing compound or "mud."

A tool assembly 4 includes a release lever 12, which is actuated by squeezing the lever 12 towards the body of the handle 14, thereby retracting a master rod 32 which rotates a first embodiment braking mechanism 38 (in this case, a pinch brake 40) thereby releasing a slave rod 34 which is a piston of the pressurized cylinder 30. The piston 34 is connected to the reservoir plunger 18. With the release lever 12 depressed, gas and/or spring pressure within the cylinder 30 pushes the slave rod 34 outwardly for continuous compound 6 dispensing until the release lever 12 is released or the handle reservoir 16 requires recharging with compound material 6.

Figure 1:
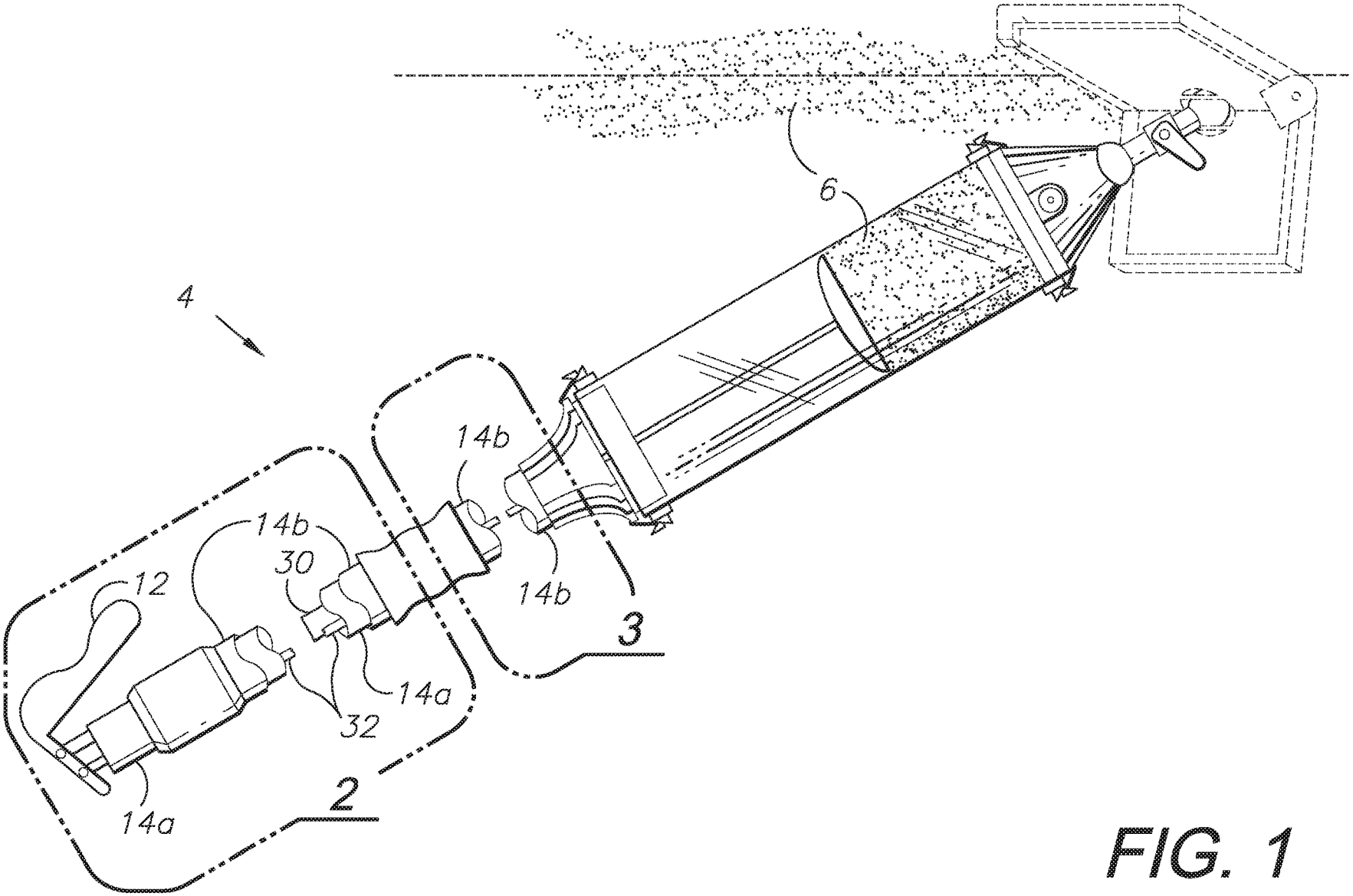
FIG. 1 shows a finishing compound dispensing system comprising an aspect of the present invention, shown in use applying finishing compound to a wall-ceiling joint.
Figure 2:
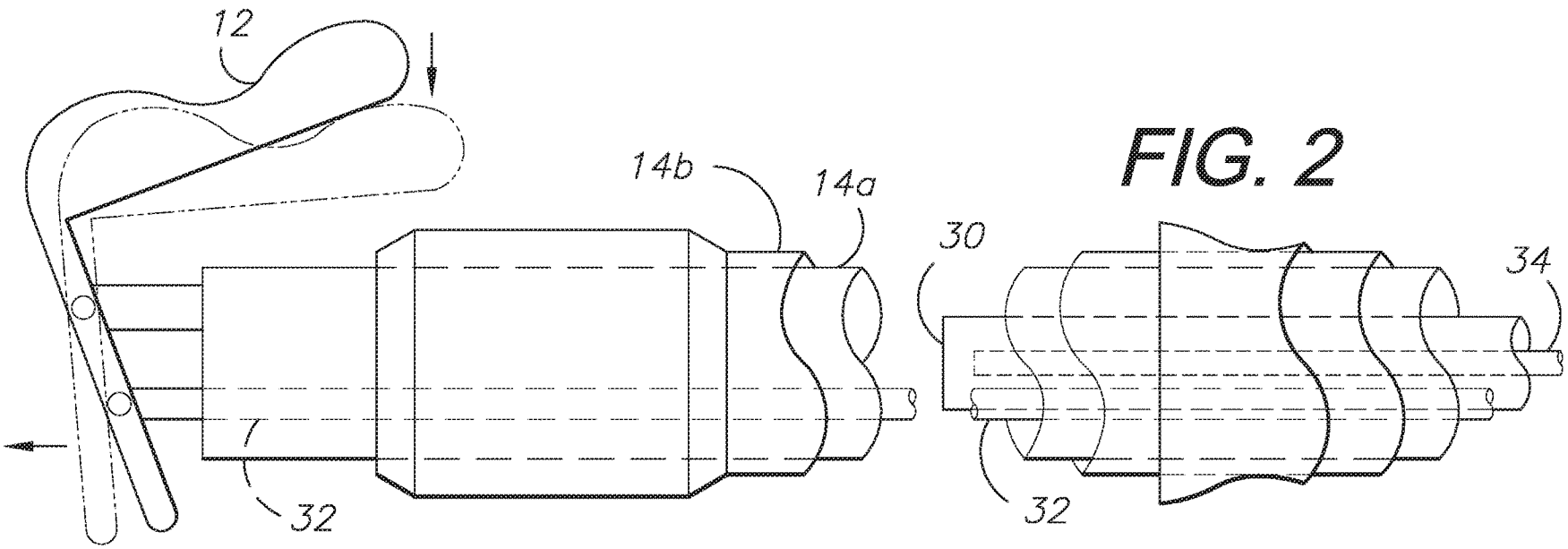
FIG. 2 is an enlarged, fragmentary view thereof, taken generally within area 2 in FIG. 1.
Figure 3:
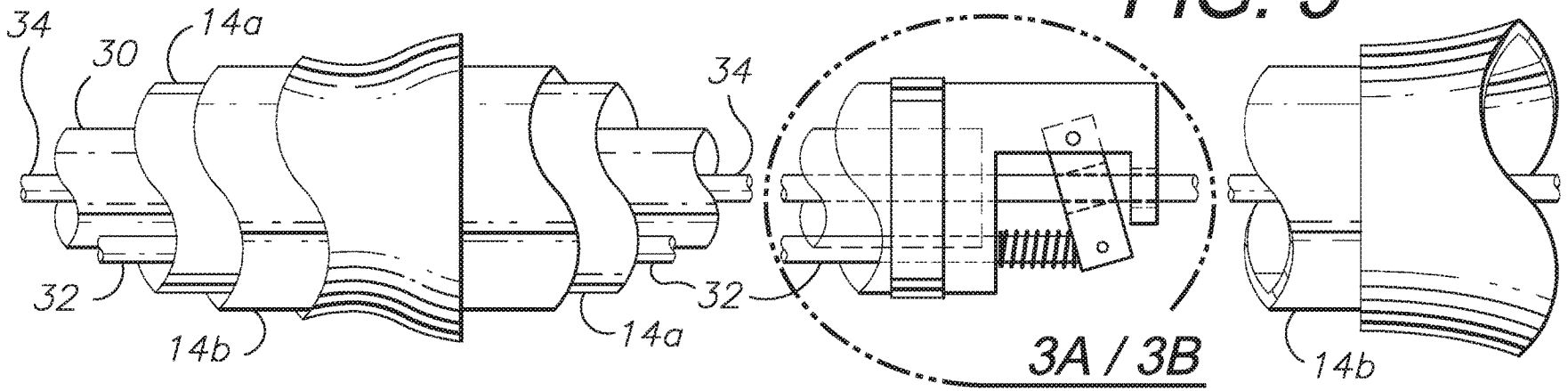
FIG. 3 is an enlarged, fragmentary view of a locking mechanism thereof, taken generally within area 3 in FIG. 1.
Figure 3A:
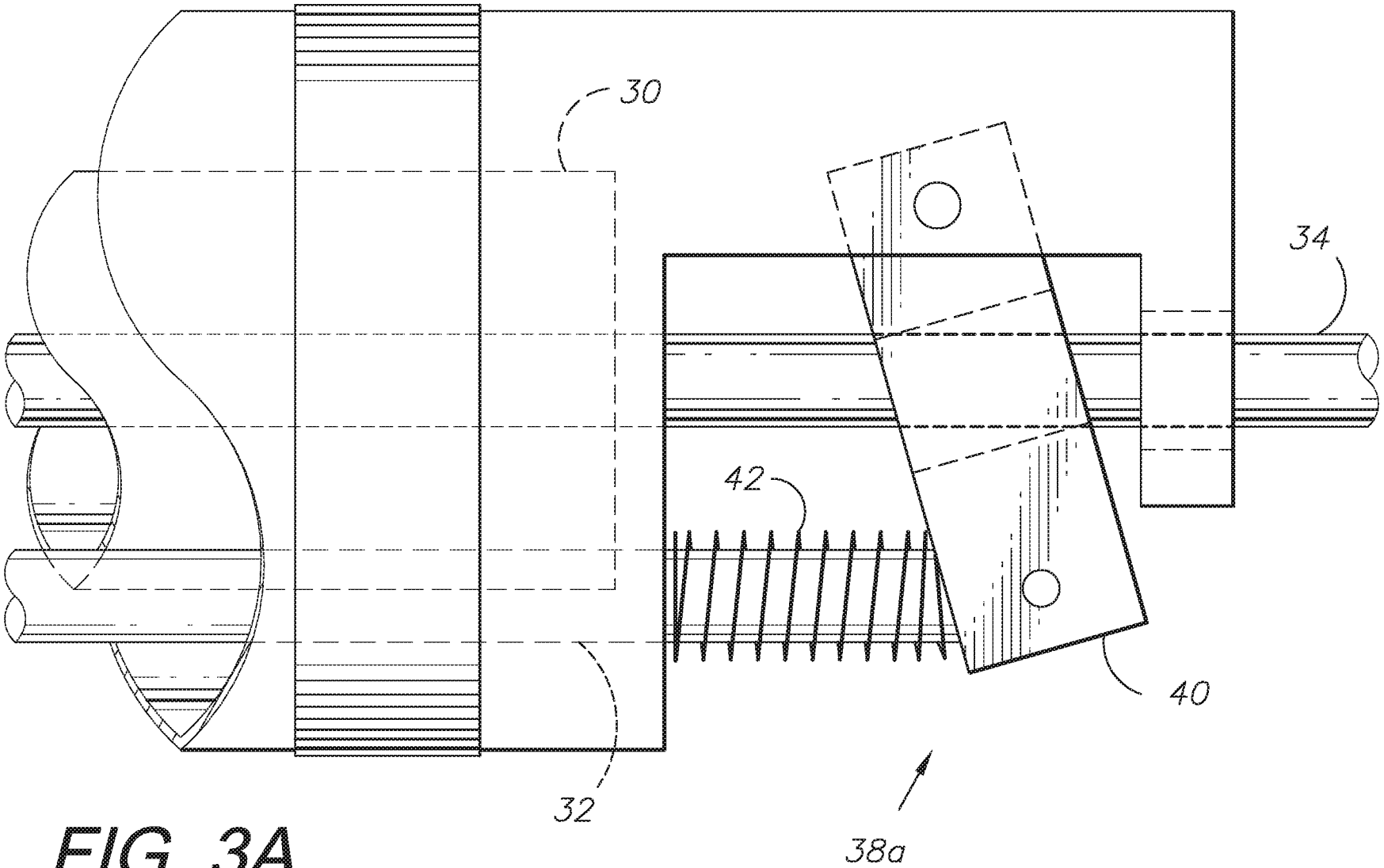
FIGS. 3A and 3B show the locking mechanism in locked and unlocked positions, respectively.
Figure 3B:
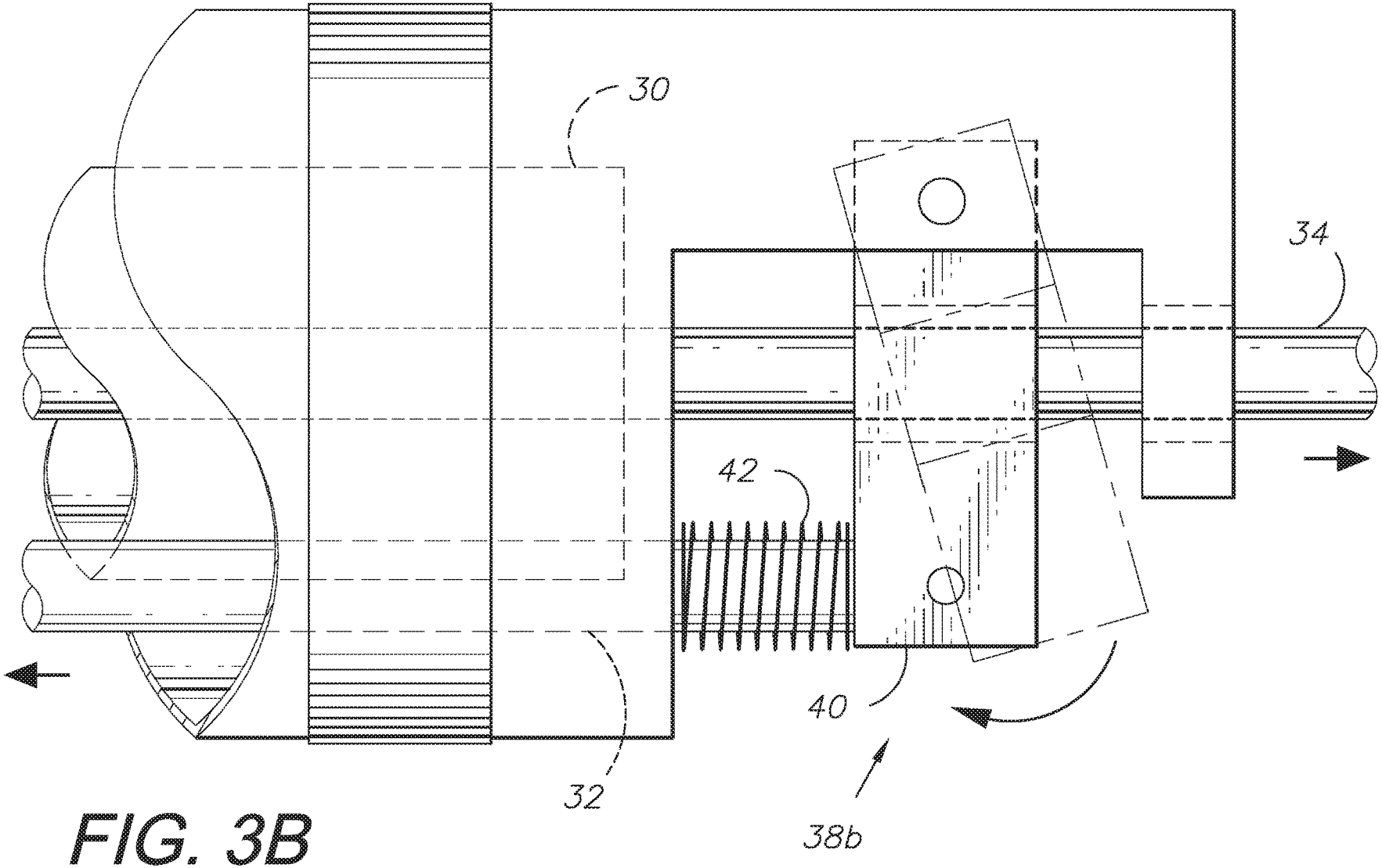
Figure 4:
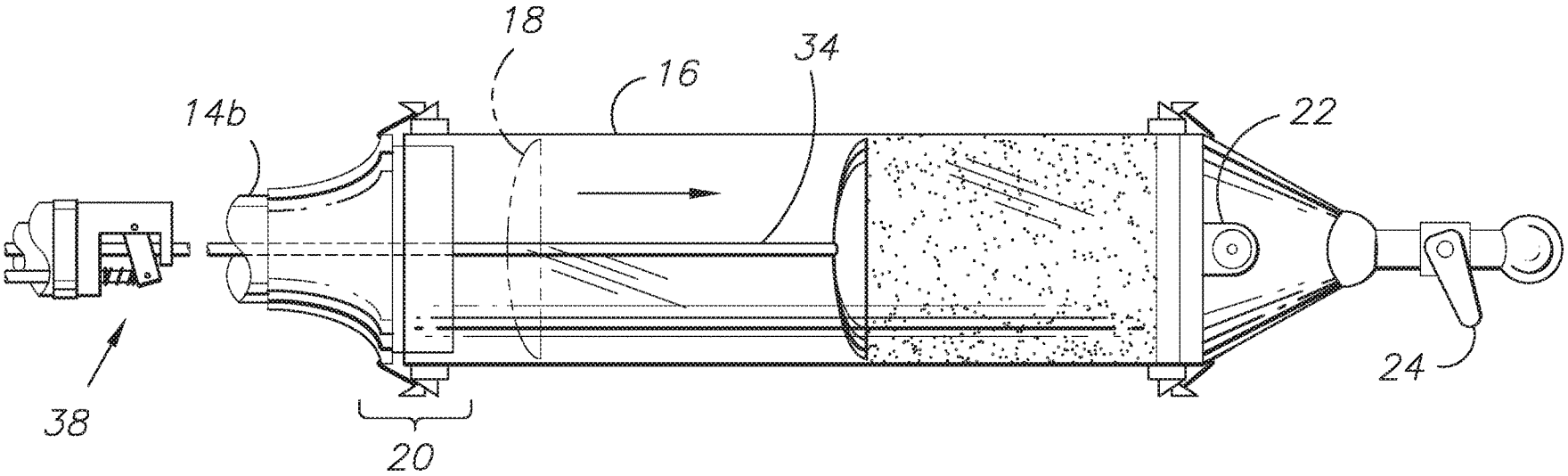
FIG. 4 is a side elevational view thereof, with portions broken away to reveal internal construction.

Upon releasing the lever 12, a first embodiment brake compression spring 42 (compressed with the retracted master rod 32) expands and extends the master rod 32, rotating the pinch brake 40 of the braking mechanism 38 in the opposite direction, thereby braking the outward motion of the slave rod 34. FIGS. 3, 3A, and 3B respectively show locked and unlocked positions 38*a*, 38*b* of the braking mechanism 38.

Reversing the direction of the slave rod 34 follows a sequence similar to that of the standard use sequence: squeezing the lever 12 retracts the master rod 32, which rotates the braking mechanism 38, thereby releasing the slave rod 34, at which point inward pressure on the opposite end of the piston 34 would re-pressurize the gas and/or spring pressure within the cylinder 30 with the slave rod 34 returned to its initial position, ready for the process to be repeated, and for recharging or reloading the reservoir 16 with drywall compound 6.

FIG. 5 shows the system 2 in a charging or loading procedure with joint compound 6 being loaded into the reservoir 16 using the pump 10, which can be placed in a bucket or other container of joint (drywall) compound. The compound 6 is pumped into the reservoir 16 through the inlet access port 22.

III. Second Modified Embodiment or Alternative Aspect of the Invention (FIGS. 6-11)

A second embodiment or aspect of the invention comprising a system designated 102 with a compound-dispensing tool 104 incorporates the use of a cam 150 in place of a pinch brake 40 and is shown in FIGS. 6-11. The cam 150 can include a groove 154 to increase surface contact between the cam 150 and a slave rod 134, thereby increasing friction and reducing the force necessary to brake the motion of the slave rod 134. A master rod 132 can attach to the cam 150 by means of a clevis assembly 156 that accommodates rotation of the cam 150.

Figure 8:
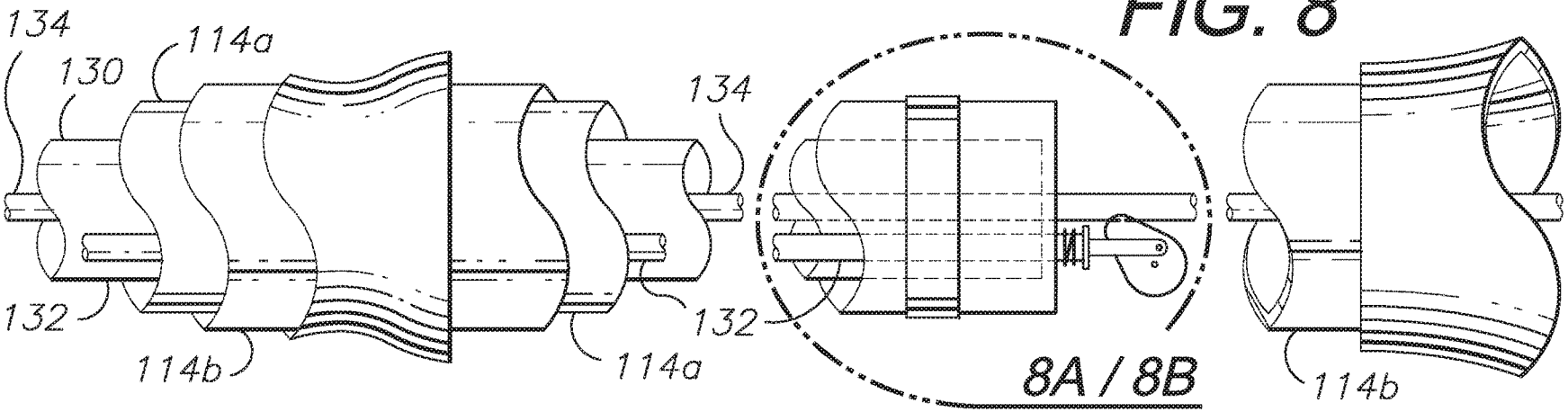
FIG. 8 is an enlarged, fragmentary view thereof, taking generally within area 8 in FIG. 6 and showing a cam-actuated locking mechanism for a pushrod thereof.
Figure 8A:
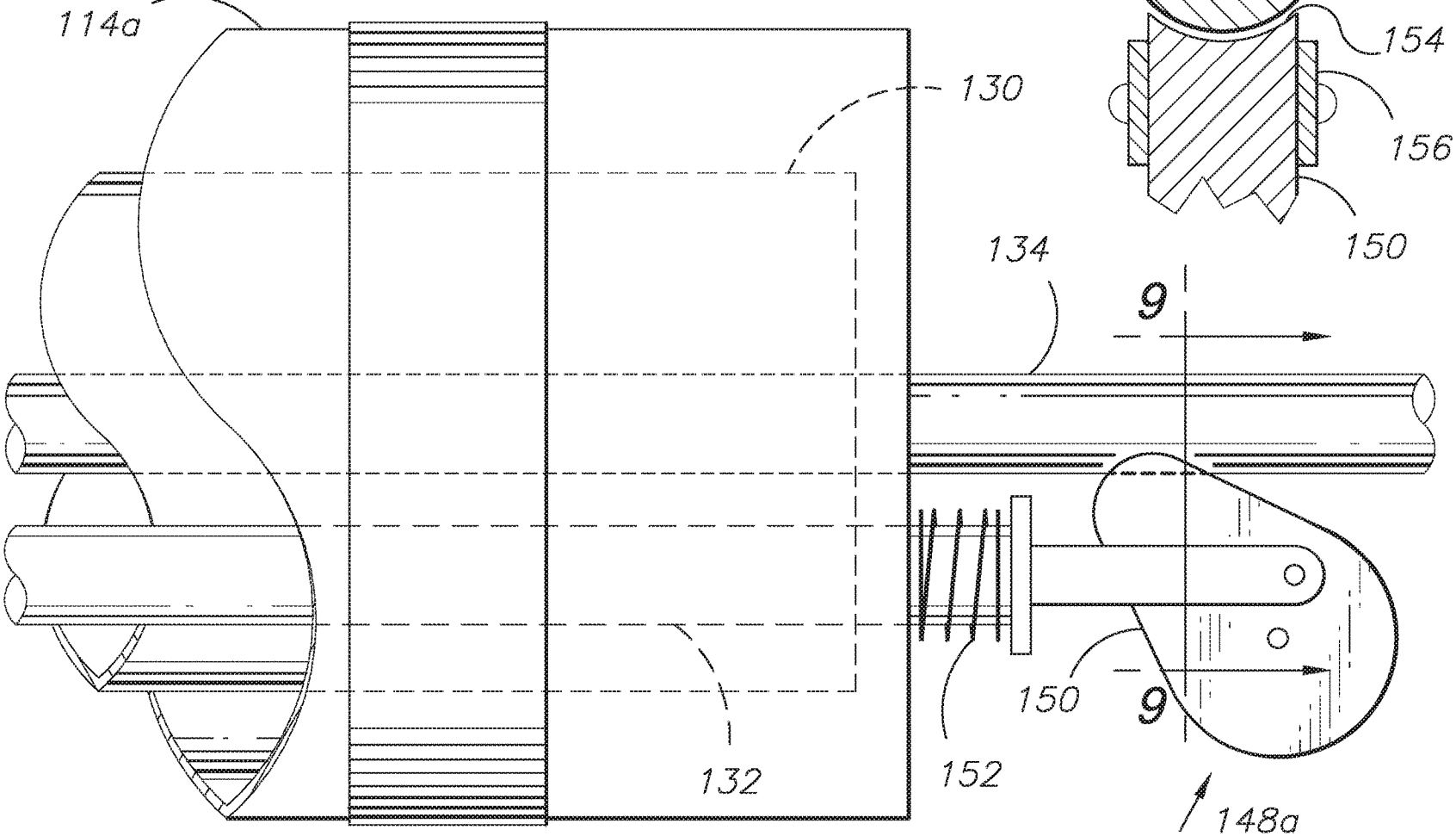
FIGS. 8A and 8B show the locking mechanism in locked and unlocked positions, respectively.
Figure 8B:
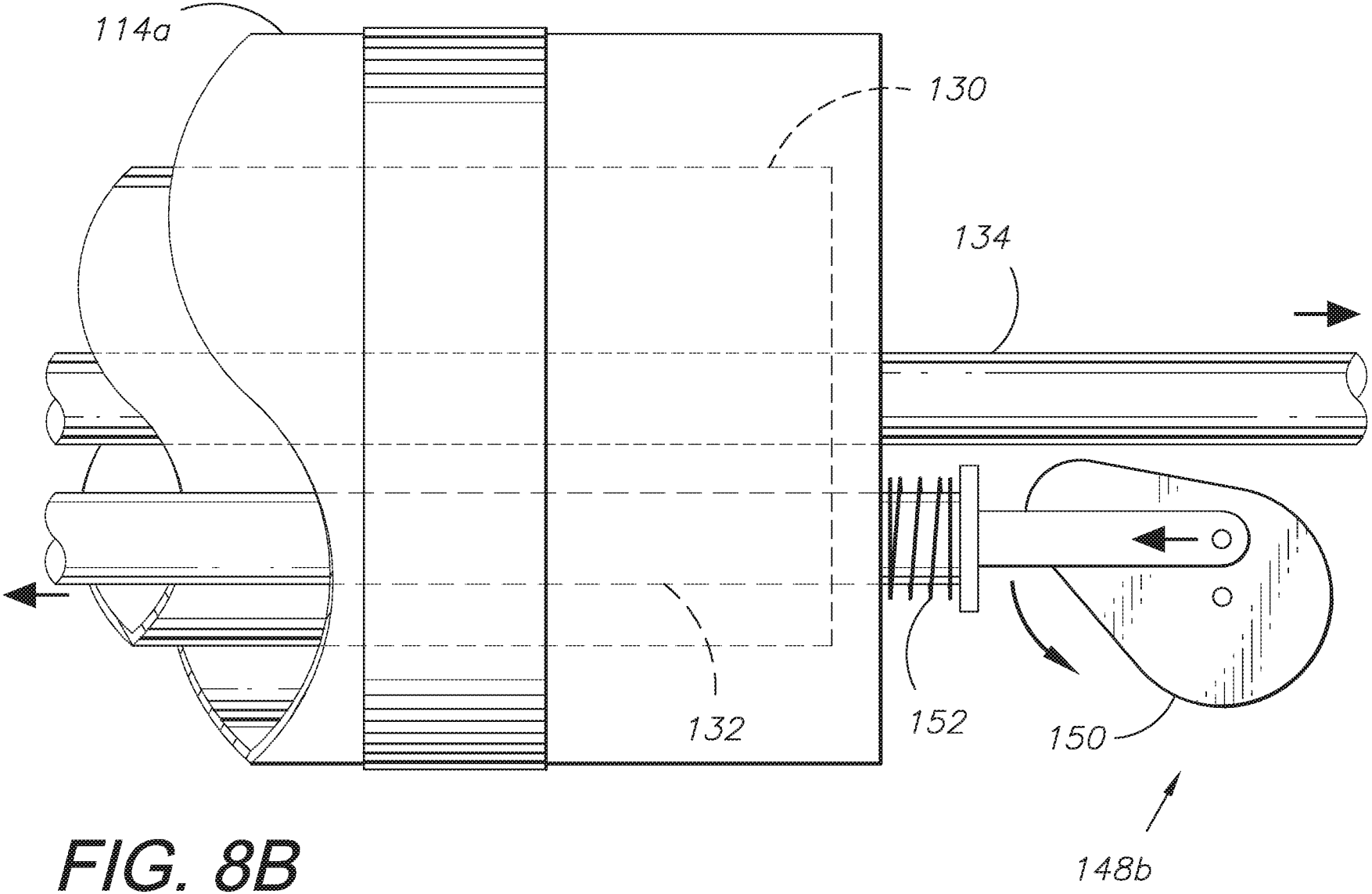
Figure 10:
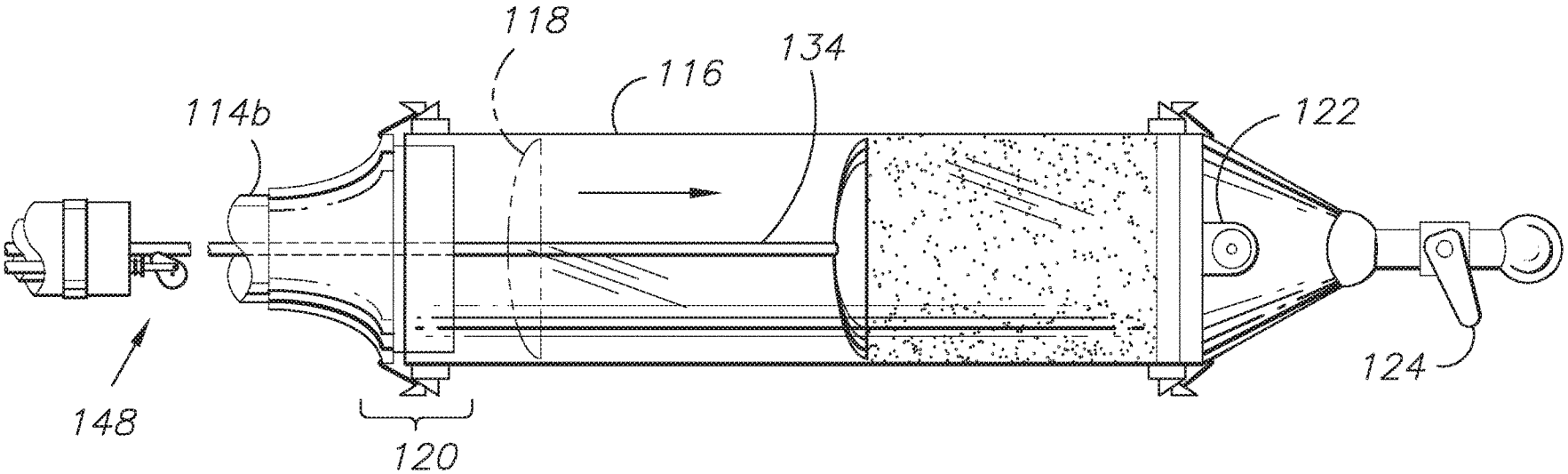
FIG. 10 is an enlarged, fragmentary, elevational view thereof.
Figure 11:
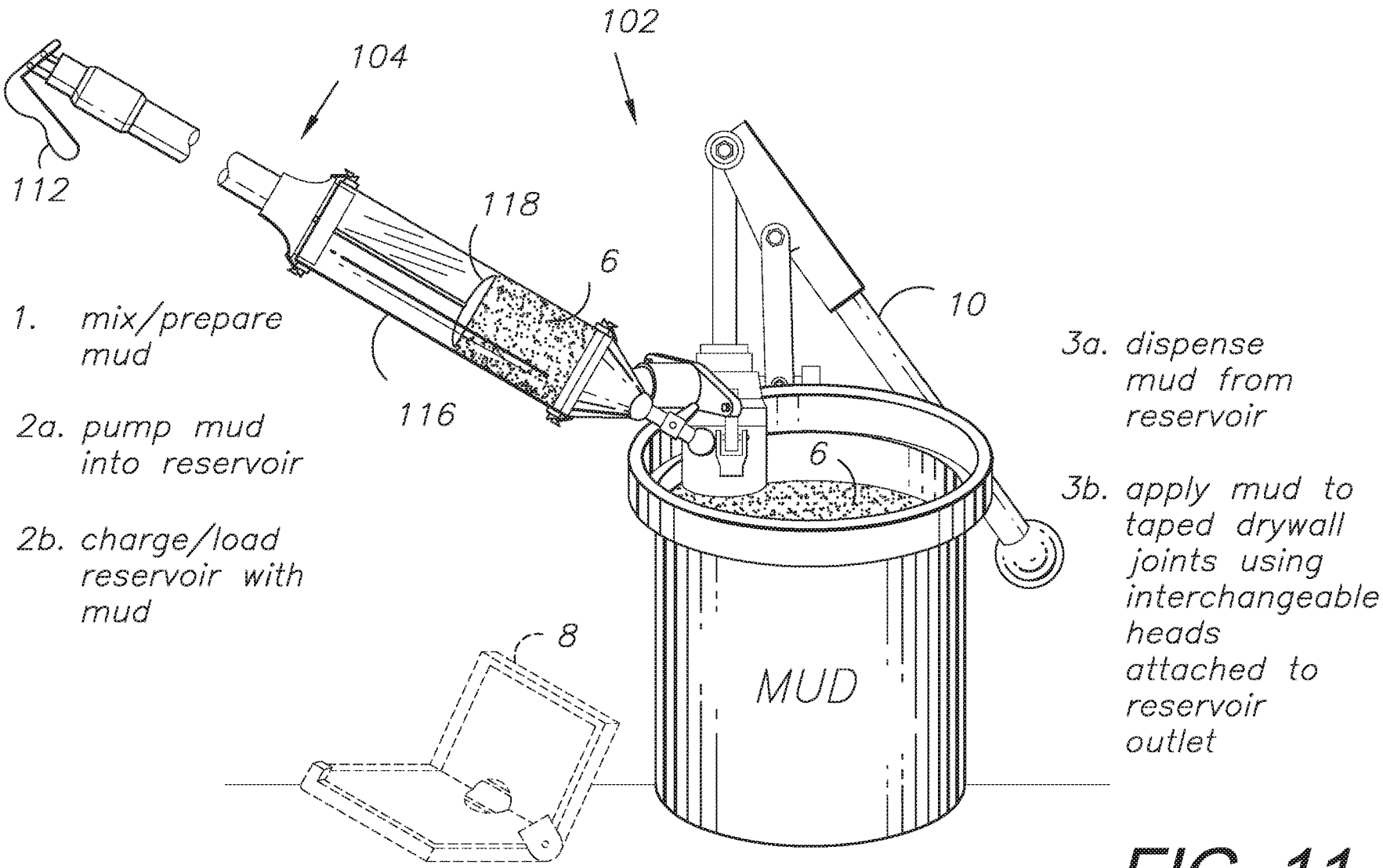
FIG. 11 shows the dispensing tool with a container of compound material, a corner-finishing attachment and a compound pump.
Figure 12:
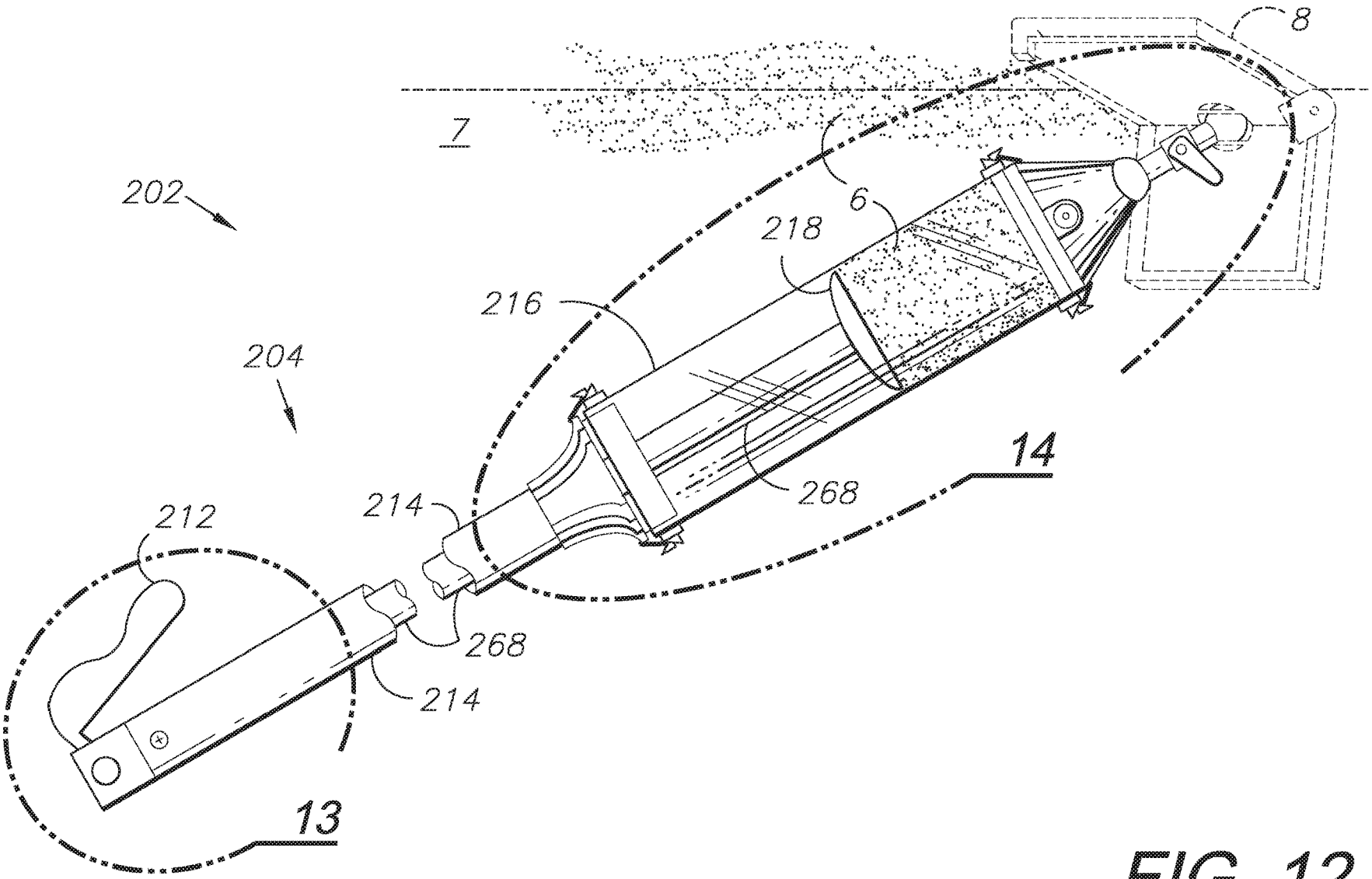
FIG. 12 shows a compound dispensing tool comprising another alternative or modified embodiment of the present invention, shown in use applying compound material to a wall-ceiling joint.

Similar to the operation of the previous embodiment, upon releasing a release lever 112, a second embodiment brake compression spring 152 squeezed by a retracted master rod 132 is allowed to expand, thereby extending the master rod 132, rotating the cam 150 of a braking mechanism 148 (in this case, a cam brake) in the opposite direction, thereby braking the outward motion of the slave rod 134. FIGS. 8A and 8B respectively show a locked position 148*a* and an unlocked position 148*b* of the braking mechanism 148.

The handle 114 can include one or more sections 114*a*, 114*b*, etc. and can be connected to a source of the compound 6 for reloading or recharging a reservoir 116 as the material 6 is applied and used. A reservoir plunger 118 can be mounted to the end of the slave rod 134 to ease dispensing. Alternative arrangements for locking and releasing the piston rod 134 of a piston 134 and cylinder 130 unit are provided. These can include, without limitation, rotatable plates, cams, and other braking mechanisms. A non-limiting example of an application for the extendable handle 114 is a drywall finishing tool 104 mounting a drywall compound (mud) distribution box 8, as well as various other taping, sanding, painting, and finishing tools and equipment.

The system 102 can, similarly to the previous embodiment, incorporate a fill access port 122, a ball valve throttle 124, and one or more openable clamp assemblies 120 to simplify use.

IV. Third Modified Embodiment or Alternative Aspect of the Invention (FIGS. 12-18)

A third embodiment or aspect of the invention (FIGS. 12-18) comprising a system designated 202 with a compound-dispensing assembled tool 204 incorporates the use of a locking, pressurized gas cylinder 268 unit (such as those manufactured by Bansbach Easylift of Lorch, Germany, for example) actuated by a release pin 264 pressed by a projection 262 of a release lever or trigger mechanism 212. Squeezing the release lever 212 (also referred to as a "trigger") toward the body of a handle 214 causes the projection 262 on the trigger mechanism 212 to depress the release pin 264 of a piston rod 266 of the locking, pressurized gas cylinder 268, thereby unlocking it. With the cylinder 268 unlocked the piston rod 266 extends and the tool dispenses compound 6 until the trigger 212 is released or the handle reservoir 216 requires recharging with compound material 6. A plunger 218 within the reservoir 216 is mounted on the end of the cylinder 268.

Upon release of the trigger 212, the release pin 264 is no longer depressed and the locking, pressurized gas cylinder 268 locks, thereby braking the outward motion of the plunger 218.

Reversing the direction of the cylinder 268 follows a sequence similar to that of the standard use sequence: squeezing the trigger 212 depresses the release pin 264, thereby unlocking the pressurized cylinder 268, at which point inward (retracting) pressure on the opposite end of the cylinder 268 would re-pressurize the gas pressure within the cylinder 268 and return the cylinder 268 to its initial position relative to the piston rod 266, ready for the process to be repeated.

Figure 13:
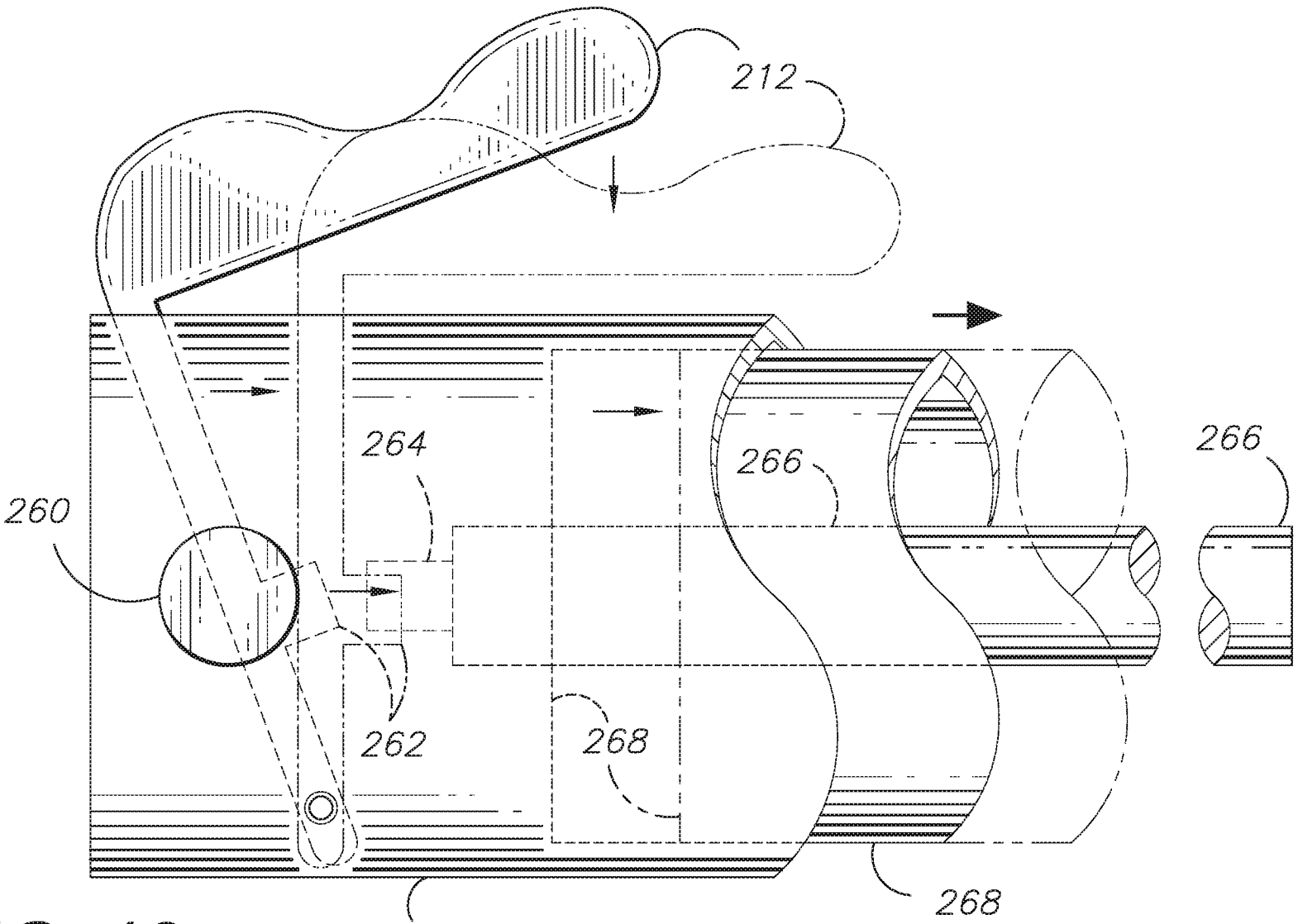
FIG. 13 is an enlarged, fragmentary view thereof, taken generally in area 13 in FIG. 12, and particularly showing an actuating handle and actuating mechanism.
Figure 13B:
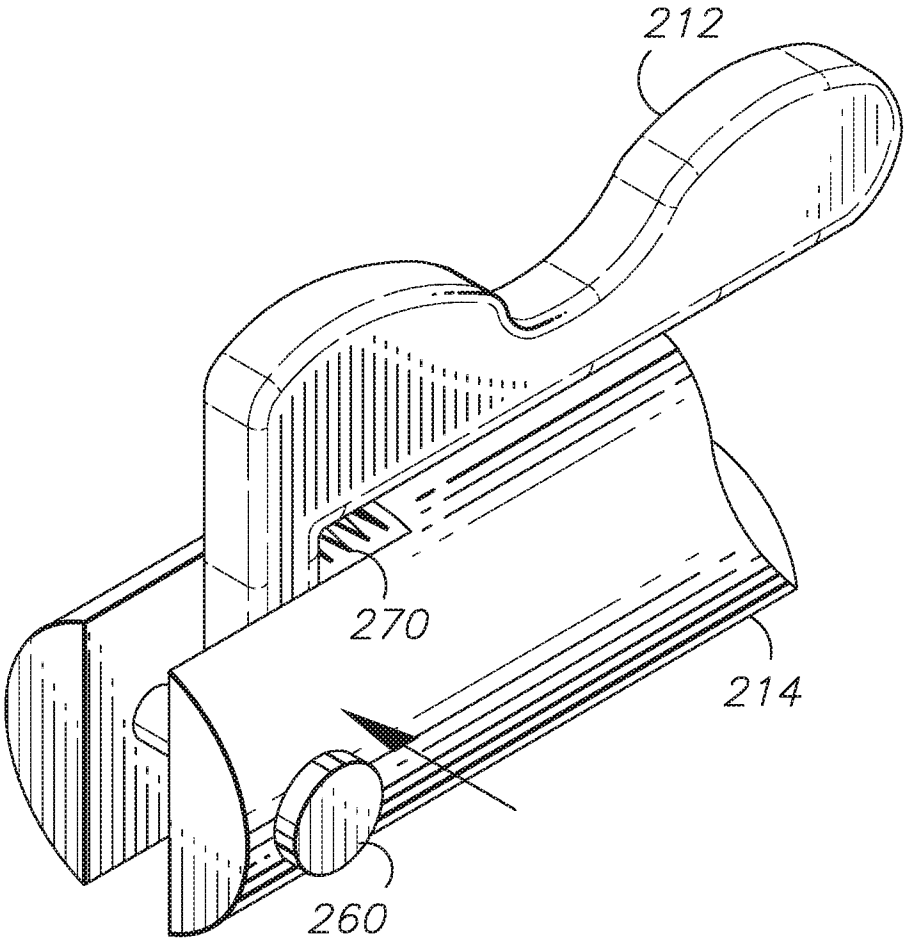
FIGS. 13A and 13B are fragmentary, perspective views of a release lever locking mechanism of the invention, shown in unlocked and locked positions, respectively.
Figure 13A:
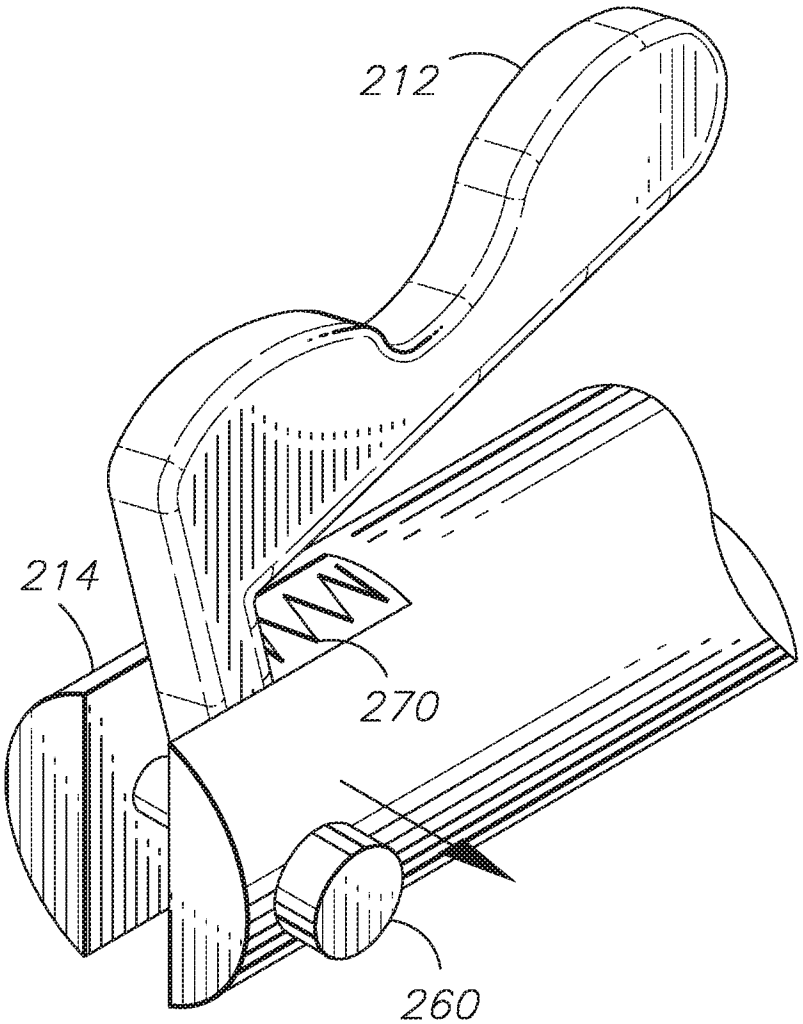
Figure 14:
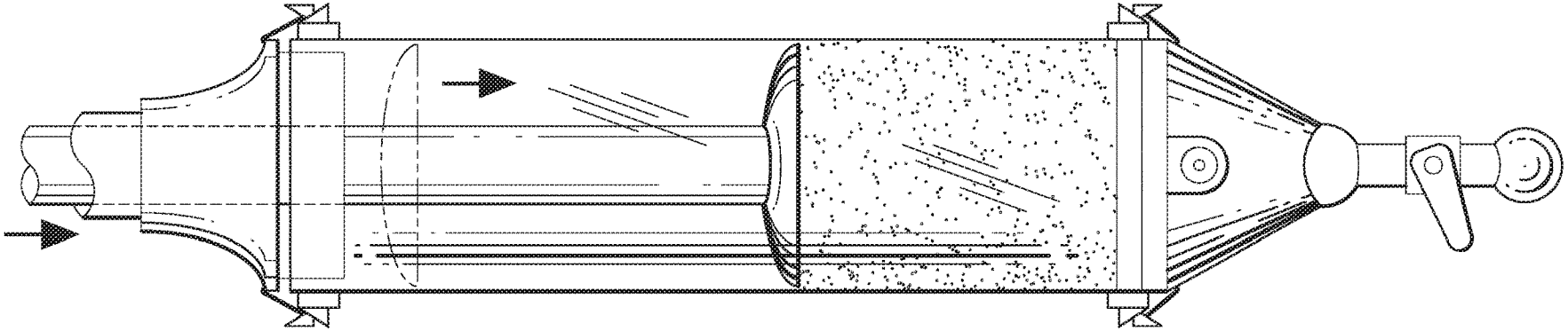
FIG. 14 is an enlarged, fragmentary view thereof, taken generally in area 14 in FIG. 12.
Figure 15:
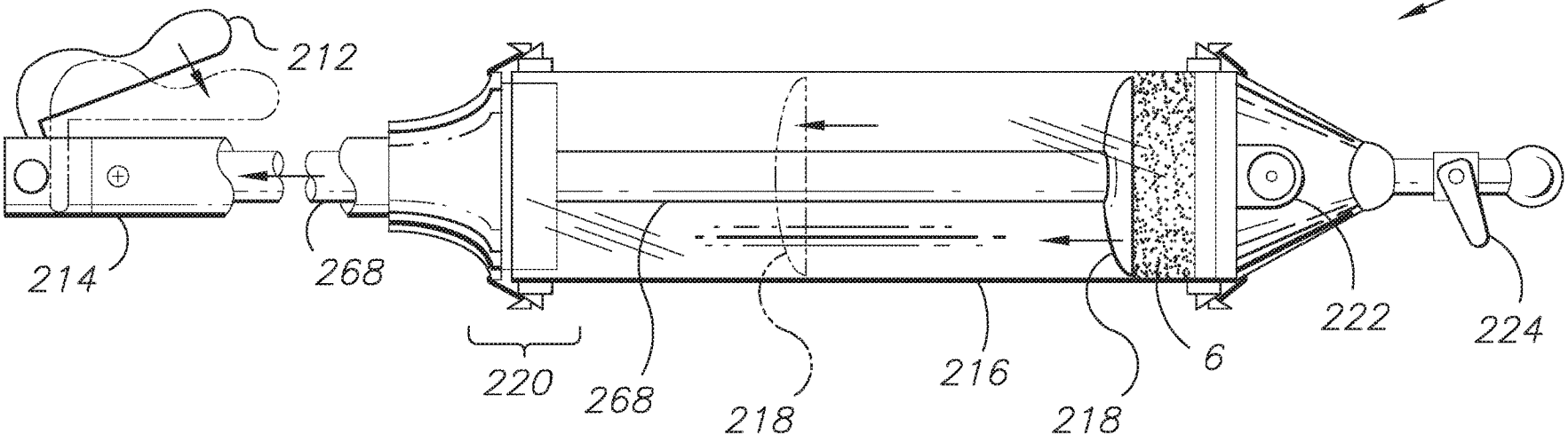
FIG. 15 is an elevational view thereof with a description of a procedure for charging the device with compound material.
Figure 16:
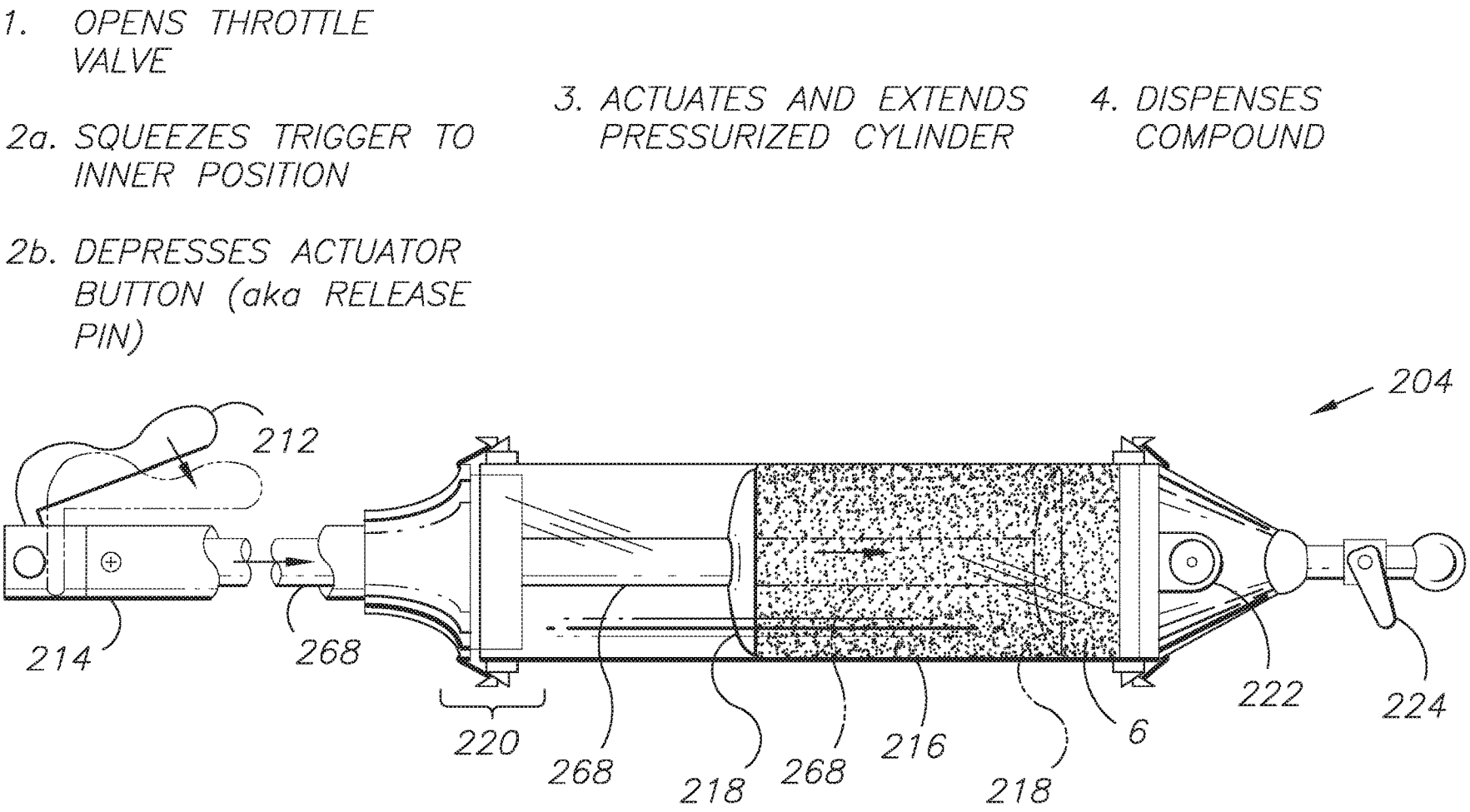
FIG. 16 is an elevational view of the invention with a description of a procedure for operating the dispenser.
Figure 17:
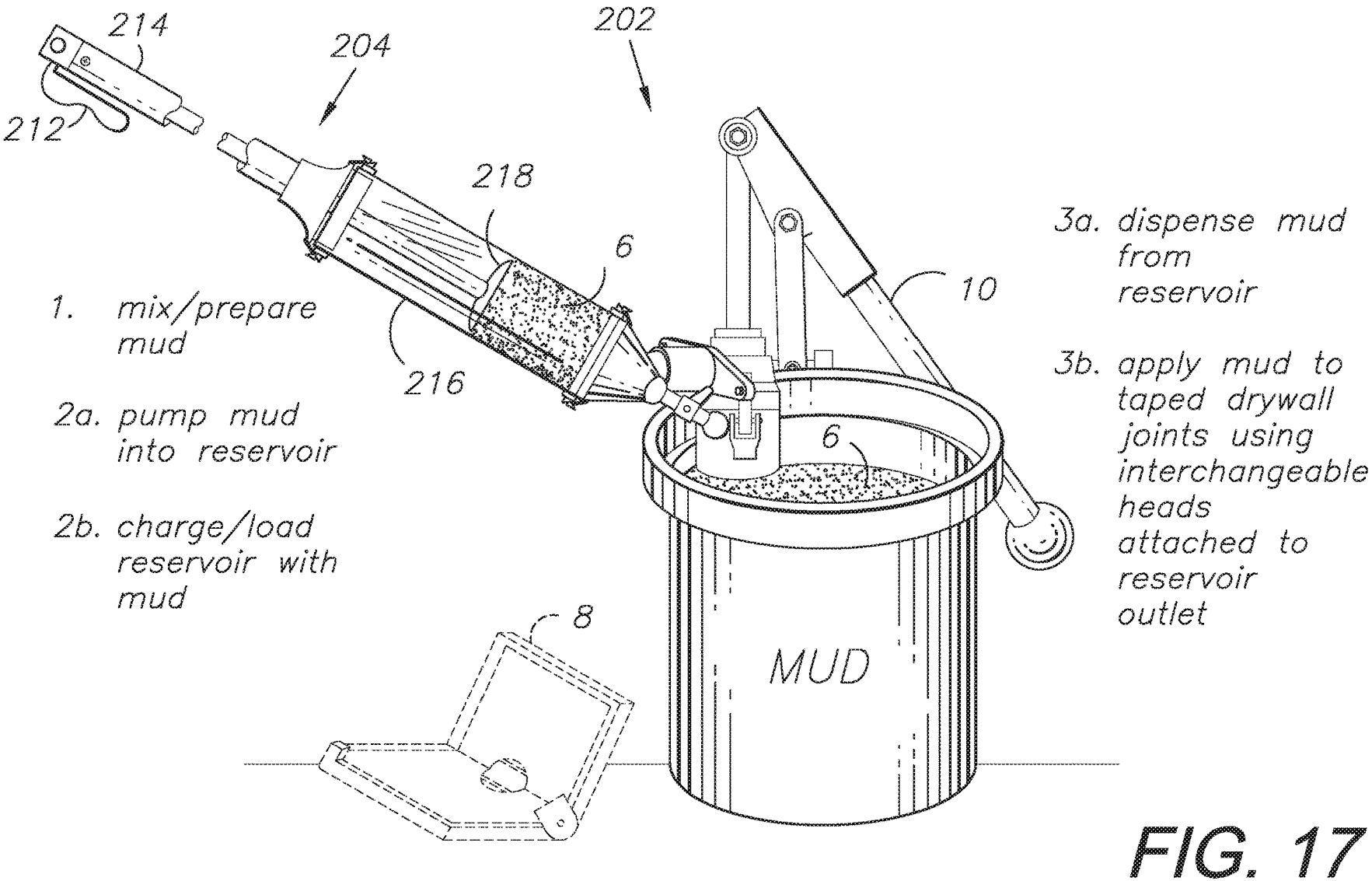
FIG. 17 is a view thereof including a compound material container, a compound pump and a corner finishing tool.
Figure 18:
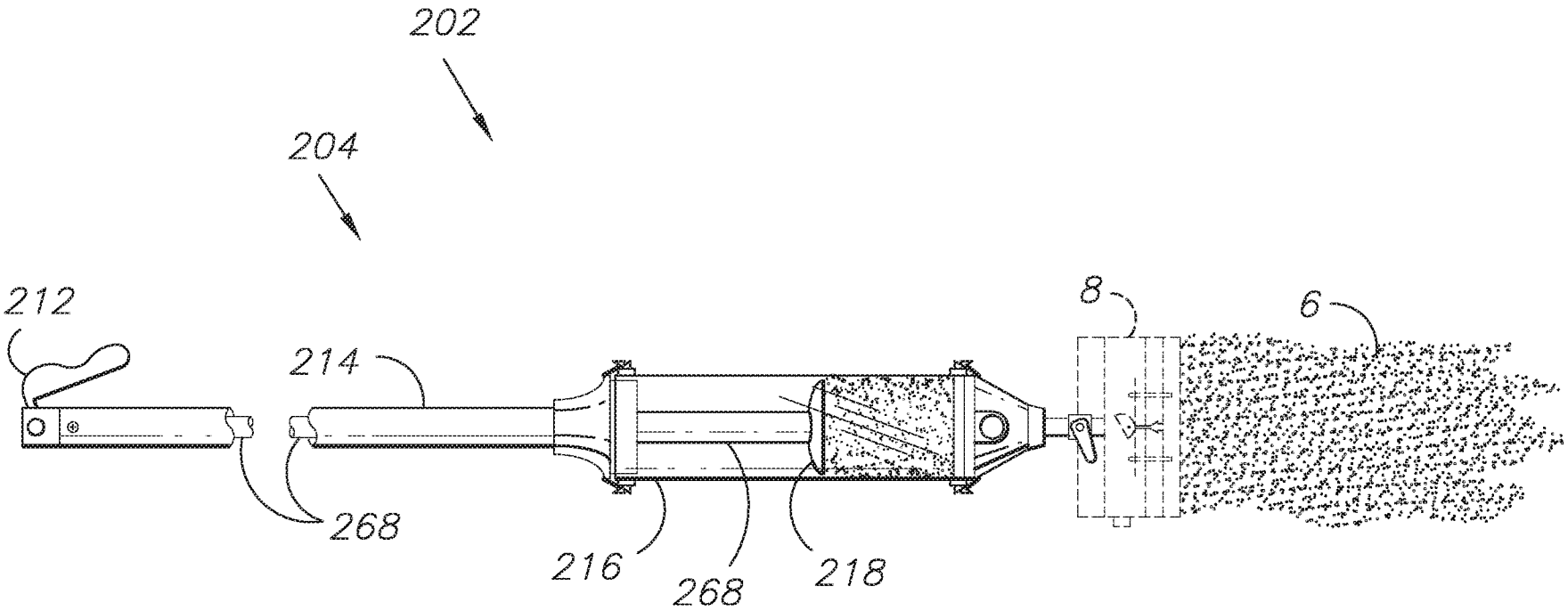
FIG. 18 is an elevational view thereof, shown in use.
Figure 19:
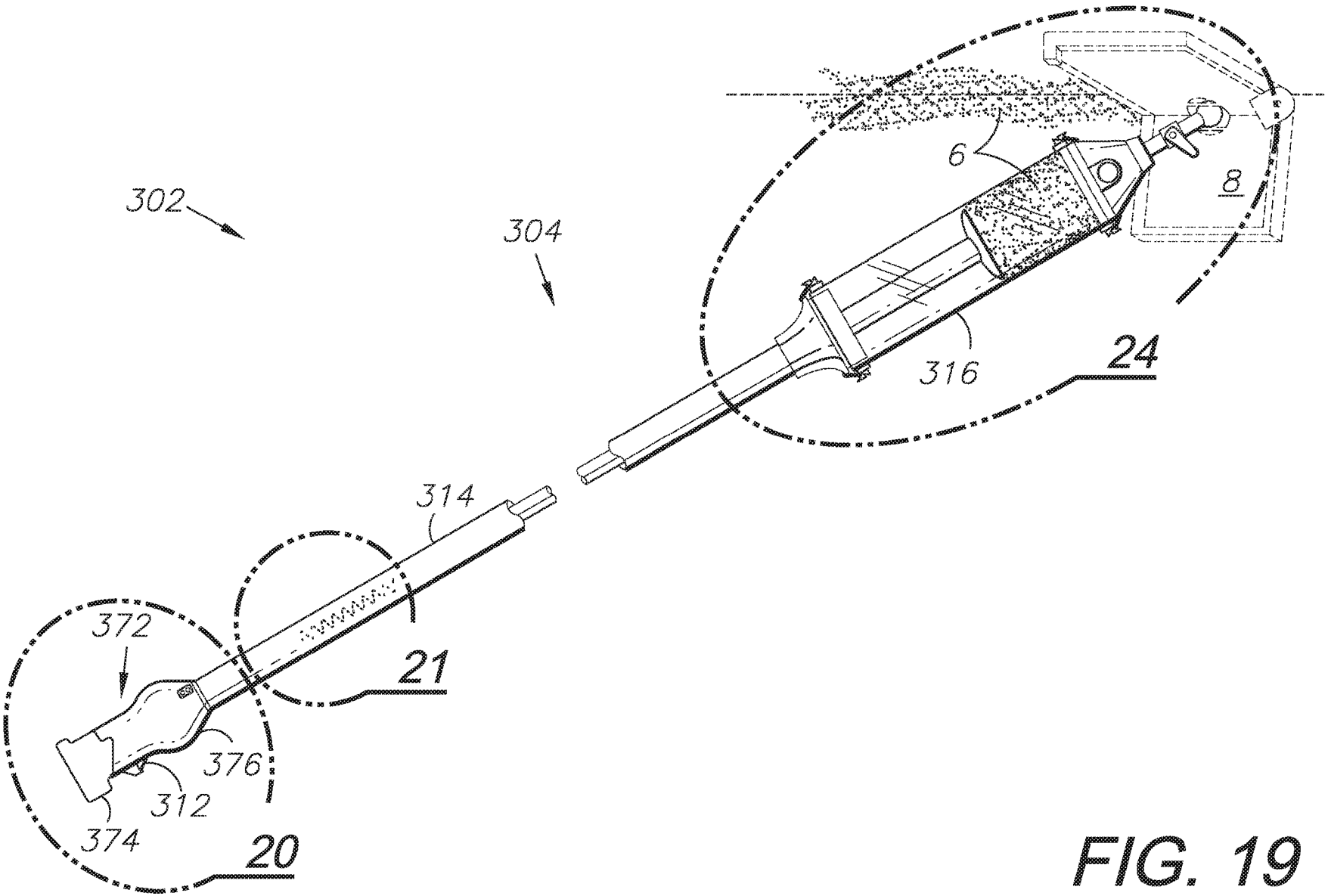
FIG. 19 shows another alternative or modified aspect of the invention, shown in use and including a rechargeable battery power source.
Figure 20:
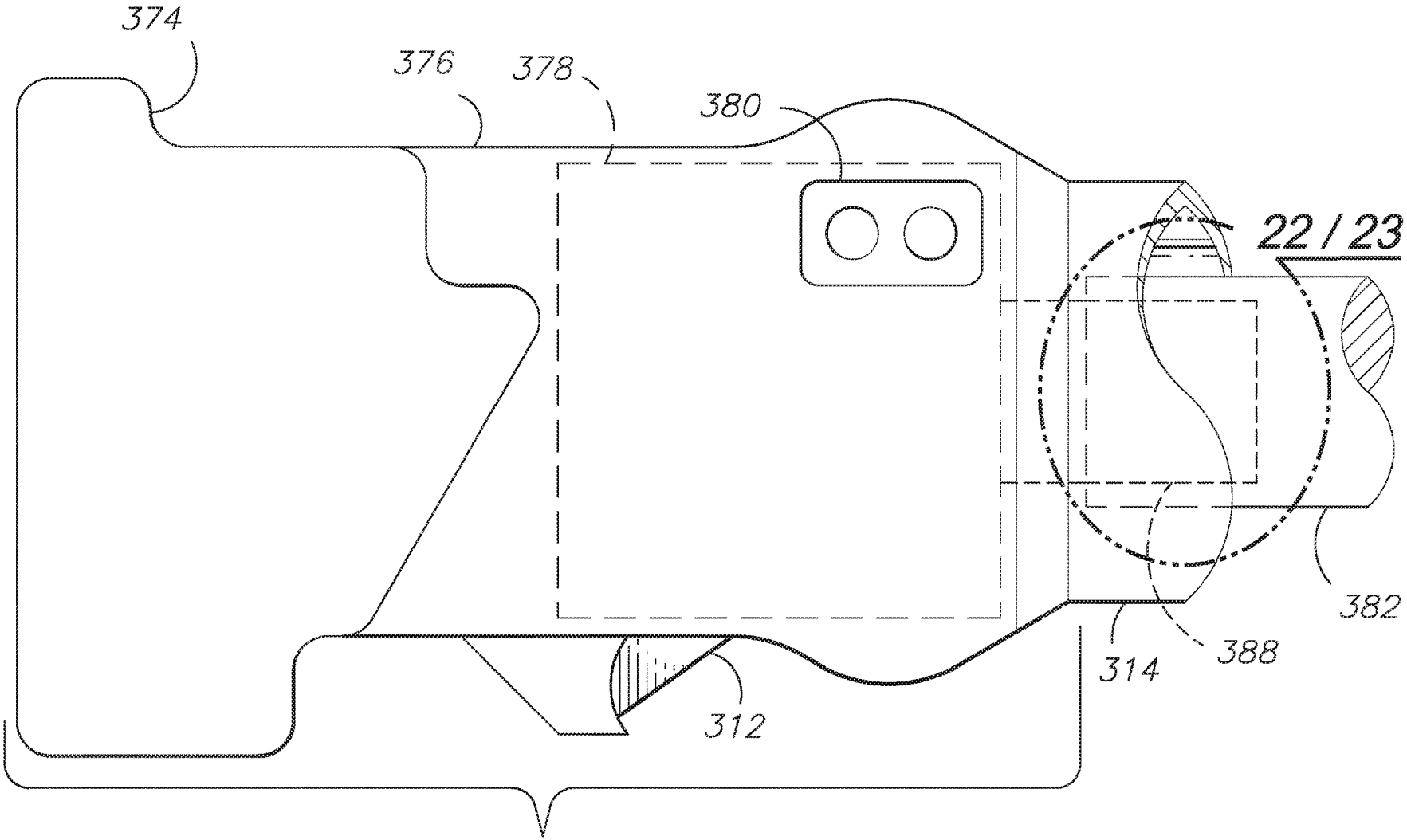
FIG. 20 is an enlarged, fragmentary view thereof, taken generally in area 20 in FIG. 19.
Figure 21:
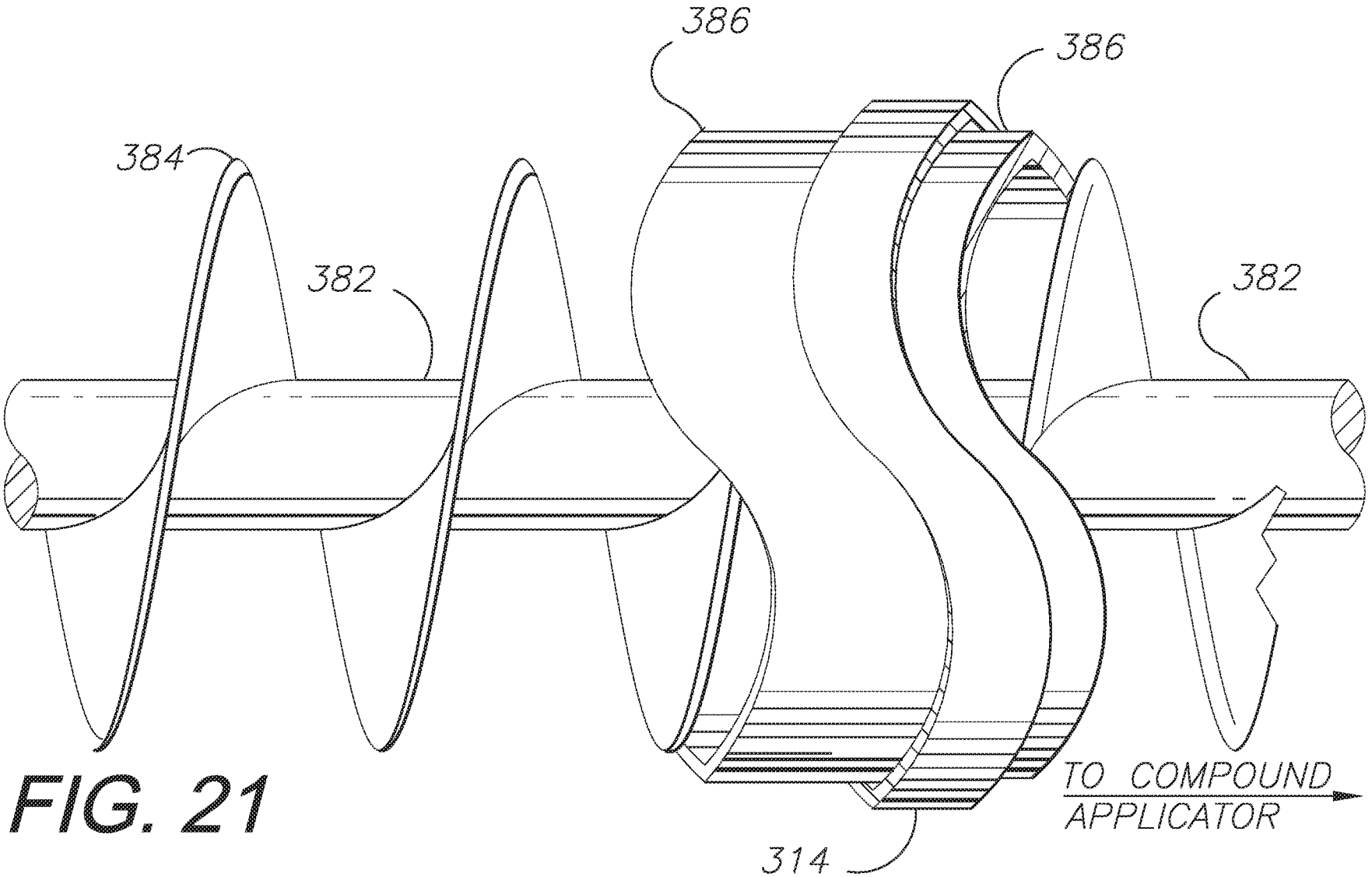
FIG. 21 is an enlarged, fragmentary view thereof, taken generally in area 21 in FIG. 19.

The system 202 can also include a trigger latch 260. FIG. 13A shows the trigger mechanism 212 in an un-engaged, extended position. The trigger latch button 260 extends from the body of the handle 214 with the trigger mechanism 212 in its extended, un-engaged position (FIG. 13A). Squeezing the trigger mechanism 212 inwardly towards the handle 214 rotates the trigger mechanism 212 out of the way of the latch 260 which can then be depressed (FIG. 13B) to retain the trigger mechanism 212 from rotating back to its un-engaged position. Upon pressing the latch button 260 again, the latch "pops out" of the way of the trigger 212. A trigger compression spring 270, compressed by the trigger, can now expand, pushing the trigger 212 back to its un-engaged position. This arrangement can aid in continuous compound 6 dispensing without requiring a user to squeeze the trigger the entire time.

Alternatively, the dispensing-locking positions of the trigger mechanism 212 can be reversed whereby squeezing the trigger mechanism 212 causes the tool assembly 204 to dispense material. The operation of the latch 260 can likewise be changed as appropriate for particular applications and to accommodate user preferences.

The system 202 can, similarly to the previously-described embodiments, incorporate a fill access port 222, a ball valve throttle 224, and/or one or more openable clamp assemblies 220 to simplify use.

V. Fourth Modified Embodiment or Alternative Aspect of the Invention (FIGS. 19-27)

Yet another alternative embodiment or aspect of the invention (FIGS. 19-27) comprises a system designated 302 and including a compound-dispensing tool 304 driven by a motor unit 372 at a proximal end of a handle 314. The motor unit 372 is powered by a rechargeable battery 374 and actuated by a trigger mechanism 312. Depressing the trigger 312, that is, squeezing it toward the body of the handle 314, activates a motor 378 which receives power from the battery 374. The motor 378 rotates a motor shaft 388 which, in turn, rotates an auger shaft 382 and auger 384, which advances the compound material 6 for discharge via an application tool 8.

Alternatively, the motor 378 can drive a threaded shaft threadably connected to a plunger 318 for expelling the material 6 contents of the reservoir 316. Upon release of the trigger 312 the motor 378 is no longer powered and ceases to rotate the shaft 382, thereby stopping the discharge flow of material 6.

A variable- or static-speed forward/reverse (reverse optional) switch 380 can be included in the assembled tool 304. The switch 380 can control the speed and rotational direction of the motor 378 and can be housed with the motor 378 within the motor housing 376. The switch 380 can include forward and reverse closed positions for dispensing compound 6 or reloading (recharging) the reservoir 316, or retracting the plunger 318.

Threaded rods, plungers and other operative components can be utilized with a reversible electric motor, such as the drive motor 378. Moreover, compound materials 6 can be loaded into and discharged from hollow portions of handles (e.g., 314) and/or reservoirs (e.g., 316) using suitable augers or shaft-plunger assemblies, which are rotated by the drive motor 378. For example, the threaded shaft 386 could extend through most of the length of the reservoir 316 and threadably mount the plunger 318 thereon for advancing and retracting through the reservoir 316 in a reciprocating range of motion.

Figure 22:
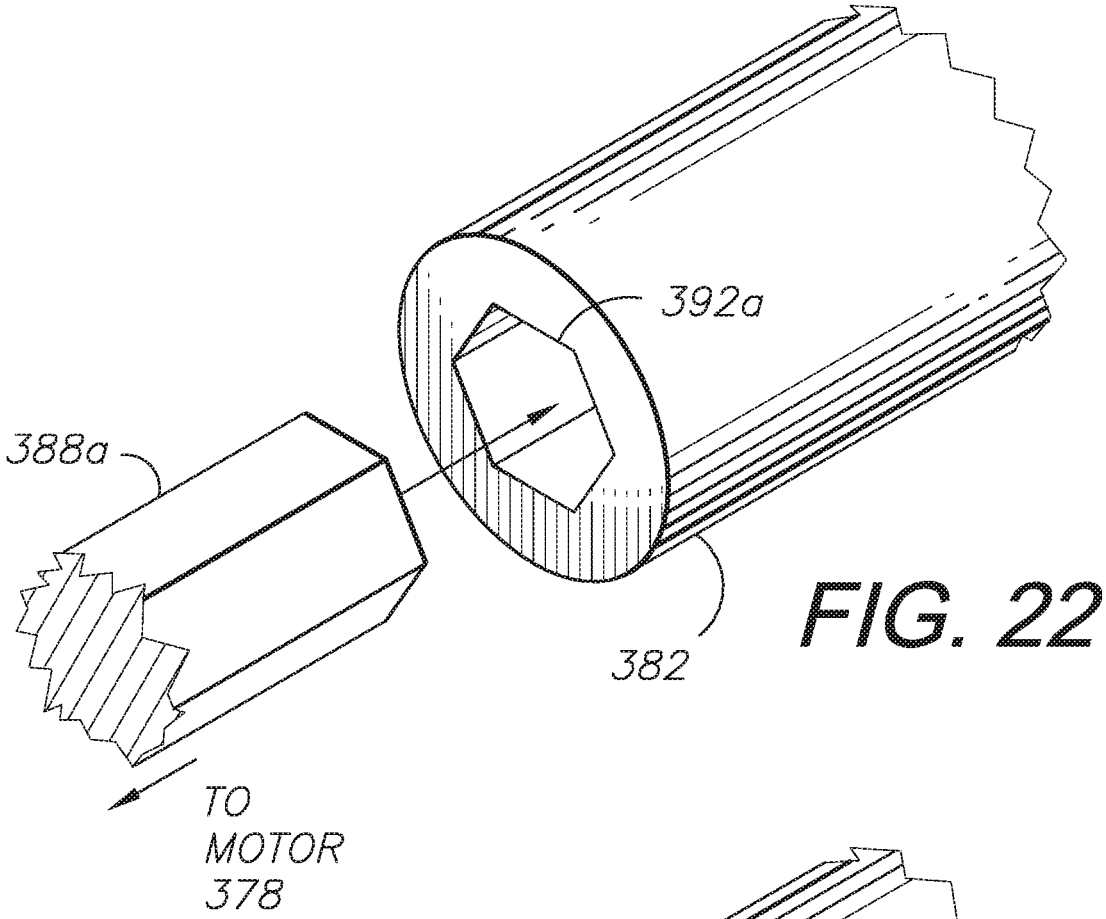
FIG. 22 is a fragmentary, perspective view thereof taken generally in area 22/23 in FIG. 20, particularly showing a connection between the motor shaft and the auger shaft.

FIG. 22 shows a mating connection between the motor 378 and the auger shaft 382. In this mating connection a hexagonal motor shaft 388*a* fits into a hexagonally-shaped hub 392*a* inside the auger shaft 382. This removable mating connection allows the motor 378 to rotate the auger shaft 382.

Figure 23:
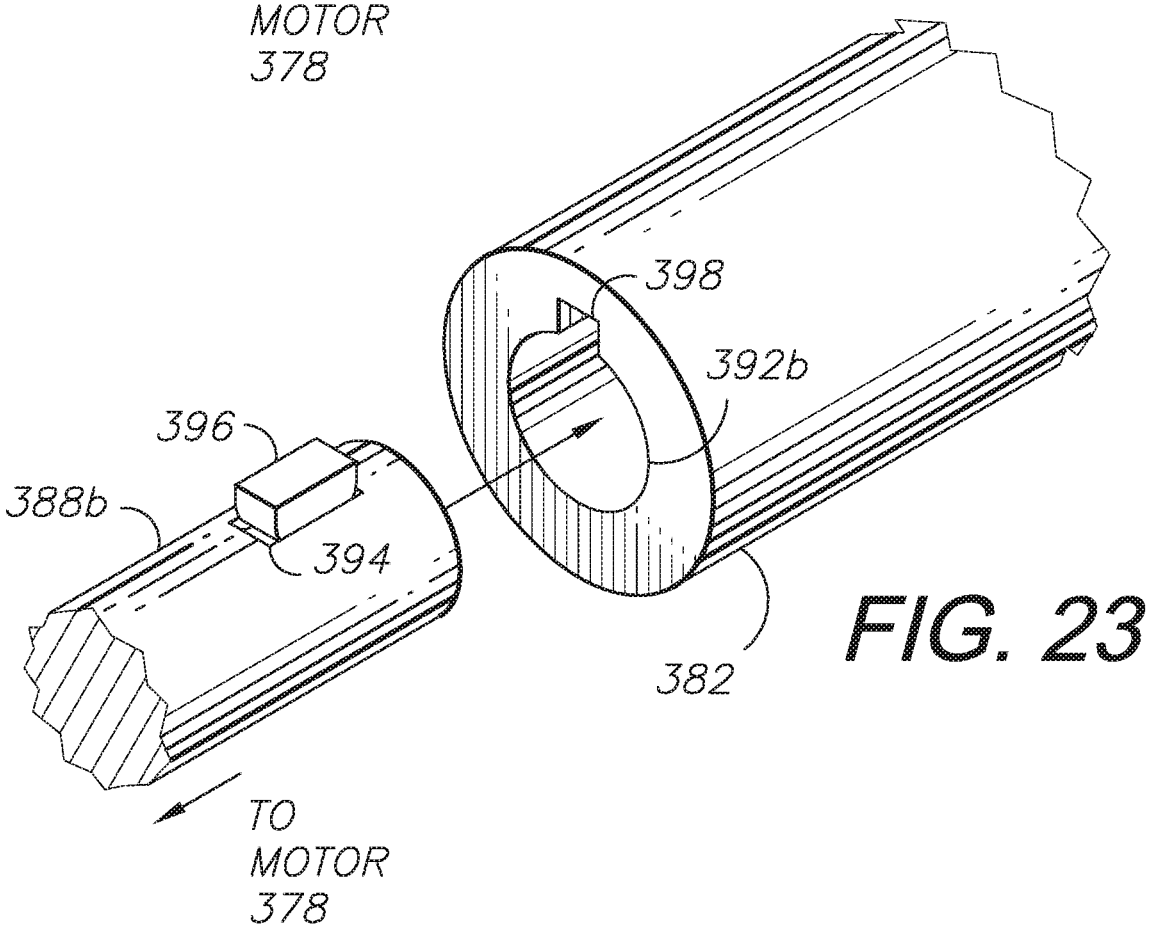
FIG. 23 is a fragmentary, perspective view thereof taken generally in area 22/23 of FIG. 20, particularly showing an alternative connection between the motor shaft and the auger shaft.
Figure 24:
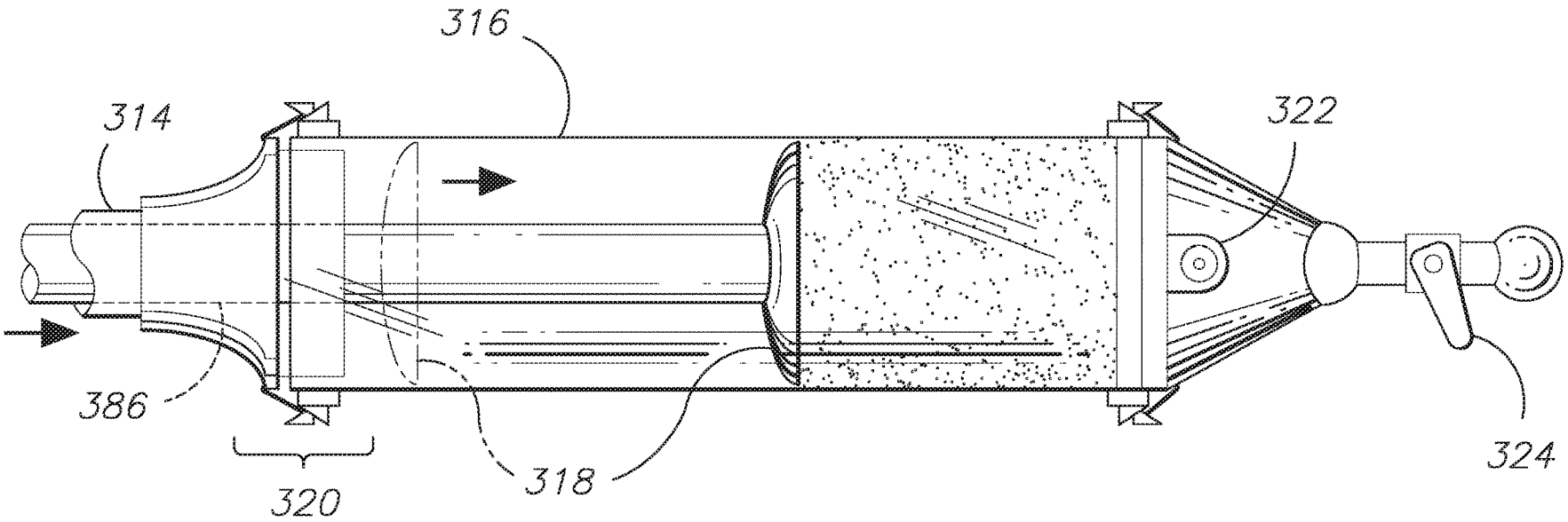
FIG. 24 is an enlarged, view thereof, taken generally in area 24 in FIG. 19.
Figure 25:
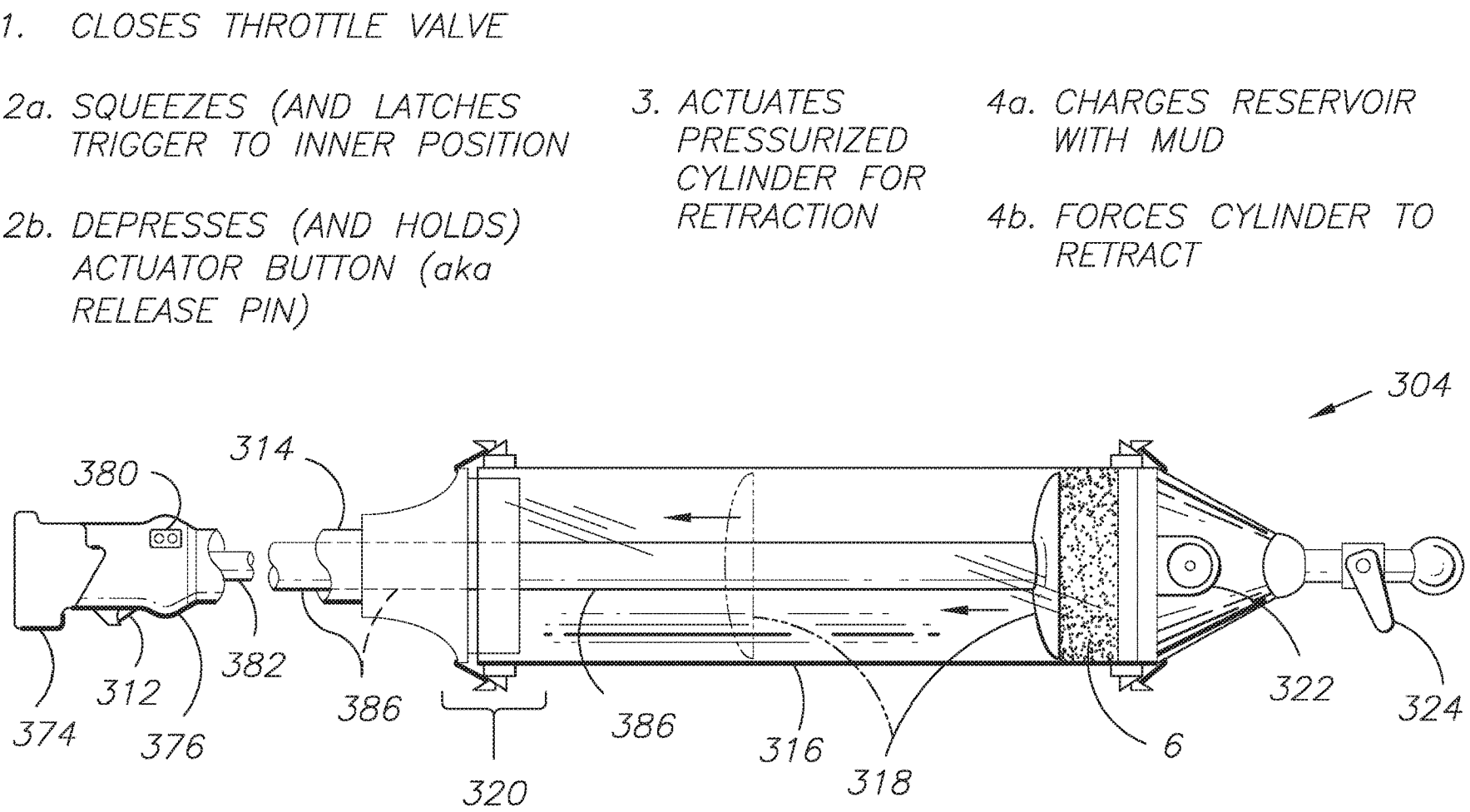
FIG. 25 is an elevational view thereof and including a description of a (re)charging process.
Figure 26:
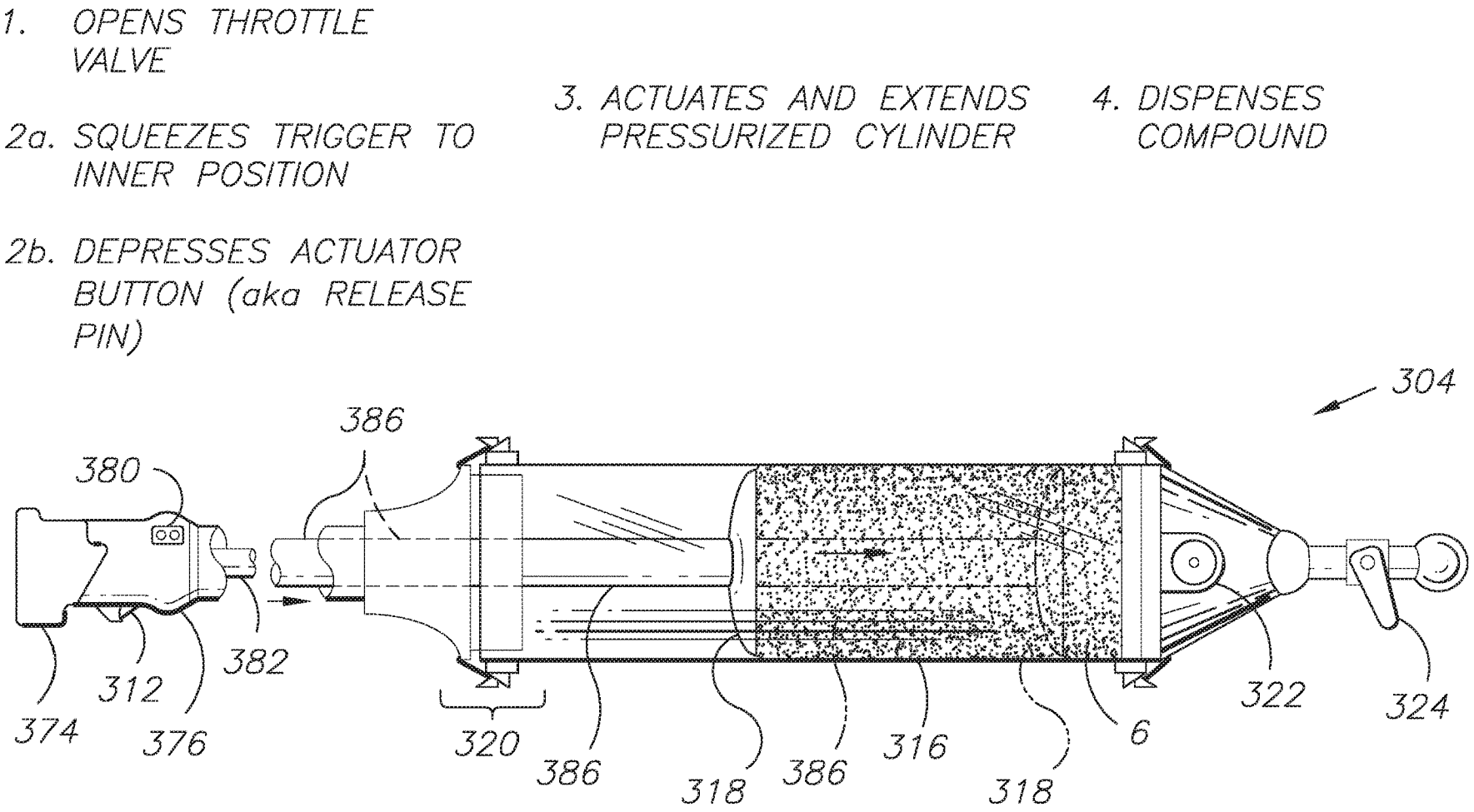
FIG. 26 is a front elevational view thereof and including a description of a dispensing process.

Another embodiment of a potential mating connection between the motor 378 and the auger shaft 382 is shown in FIG. 23. This embodiment of a mating connection employs a keyed motor shaft 388*b* to fit inside a keyed hub 392*b* within the auger shaft. An example key seat 394, key 396, and key way 398 are depicted in FIG. 23. The key arrangement shown is one example of a potential key connection and is not intended to be limiting. Keyed connections including other arrangements thereof are common in the art and should be easily understood by one skilled in the art.

Figure 27:
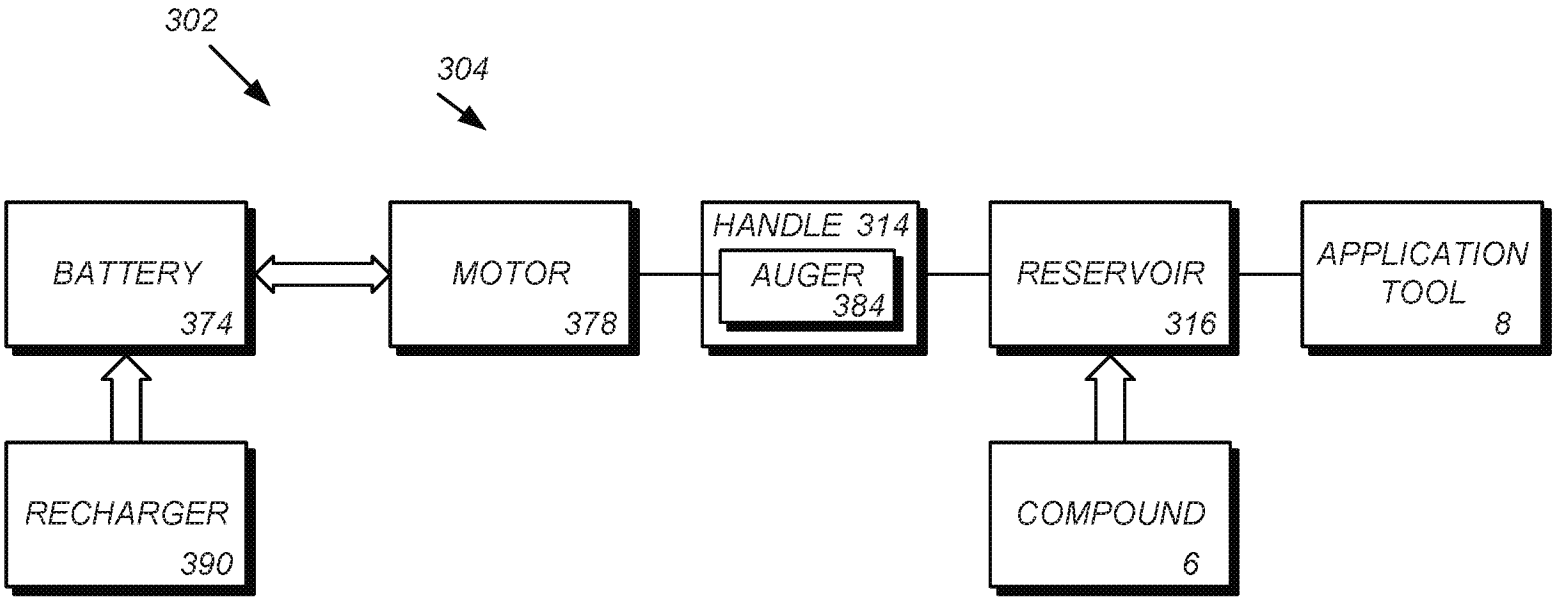
FIG. 27 is a block diagram of a compound application system embodying an aspect of the present invention.

The battery 374 can be recharged by removing it from the assembled tool 304 and connecting it to a charger 390 (FIG. 27).

The system 302 can, similarly to the previous embodiments, incorporate a fill access port 322, a ball valve throttle 324, and one or more openable clamp assemblies 320 to simplify use.

VI. Fifth Modified Embodiment or Alternative Aspect of the Invention (FIGS. 28-34)

Figure 28:
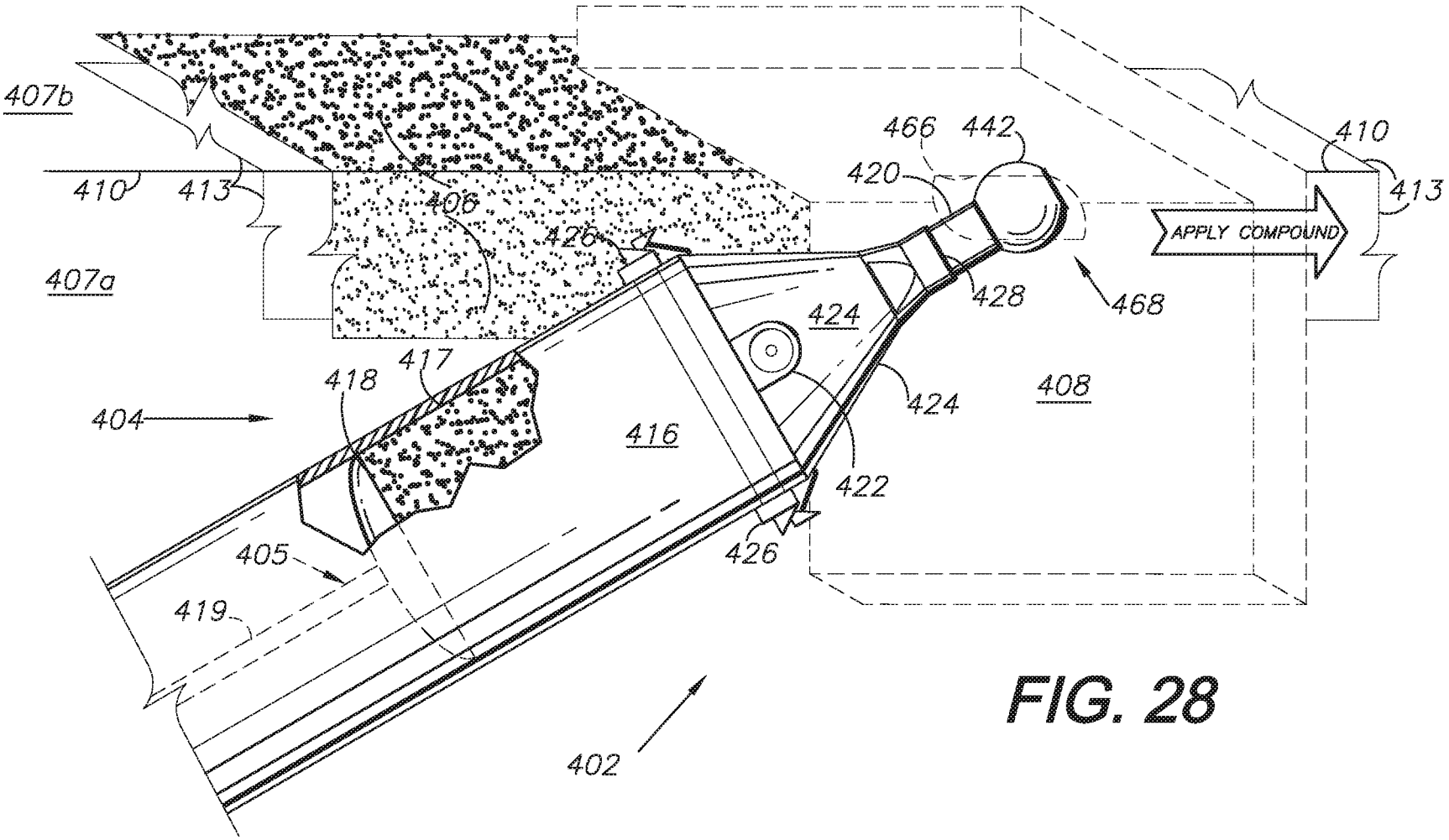
FIG. 28 is a fragmentary view of a compound applicator comprising another modified or alternative aspect of the present invention with a push-to-open check valve, shown applying compound to a horizontal, wall-ceiling joint.
Figure 29:
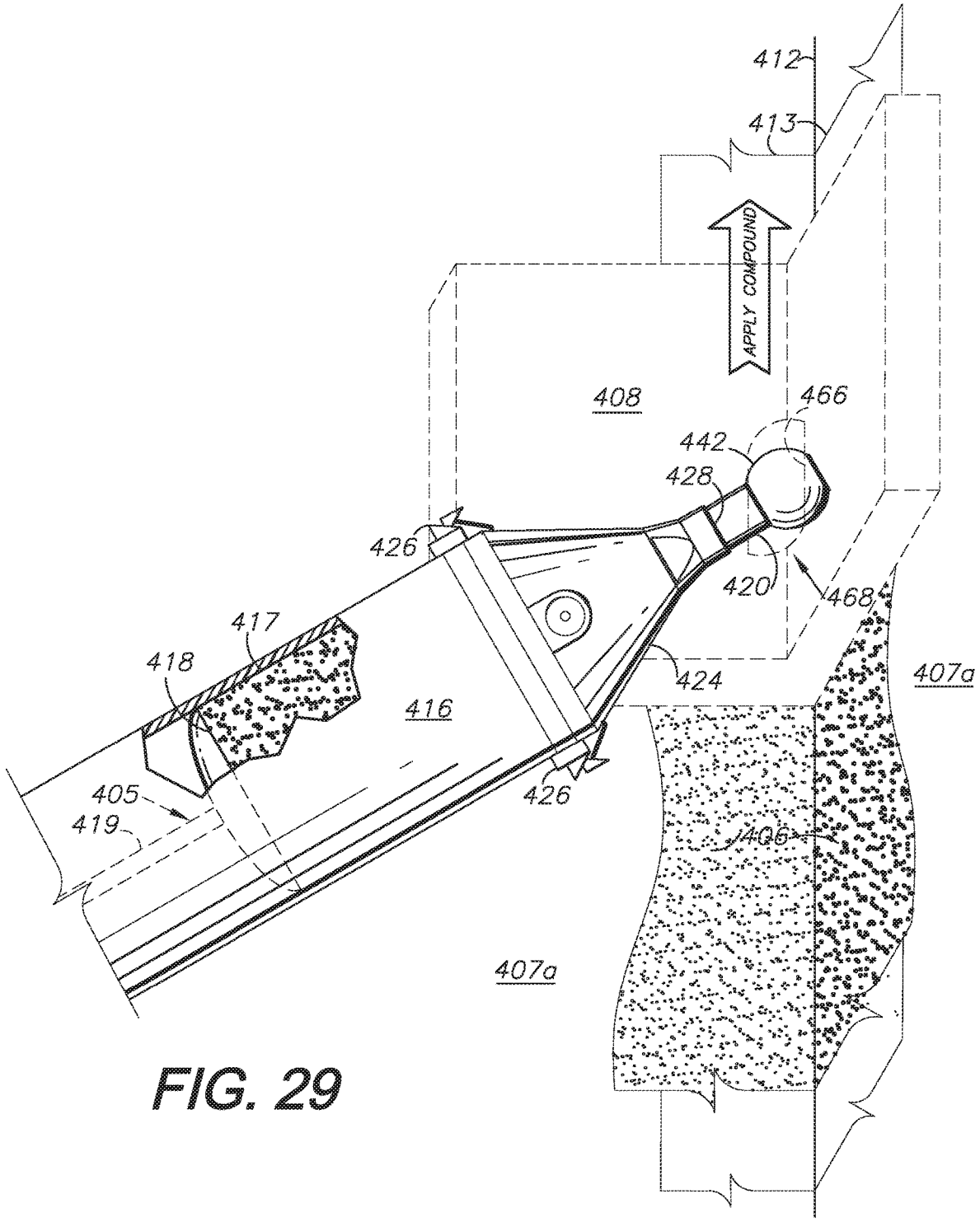
FIG. 29 is a fragmentary view of the modified, push-to-apply applicator, shown applying compound to a vertical, wall-wall joint.
Figure 34:
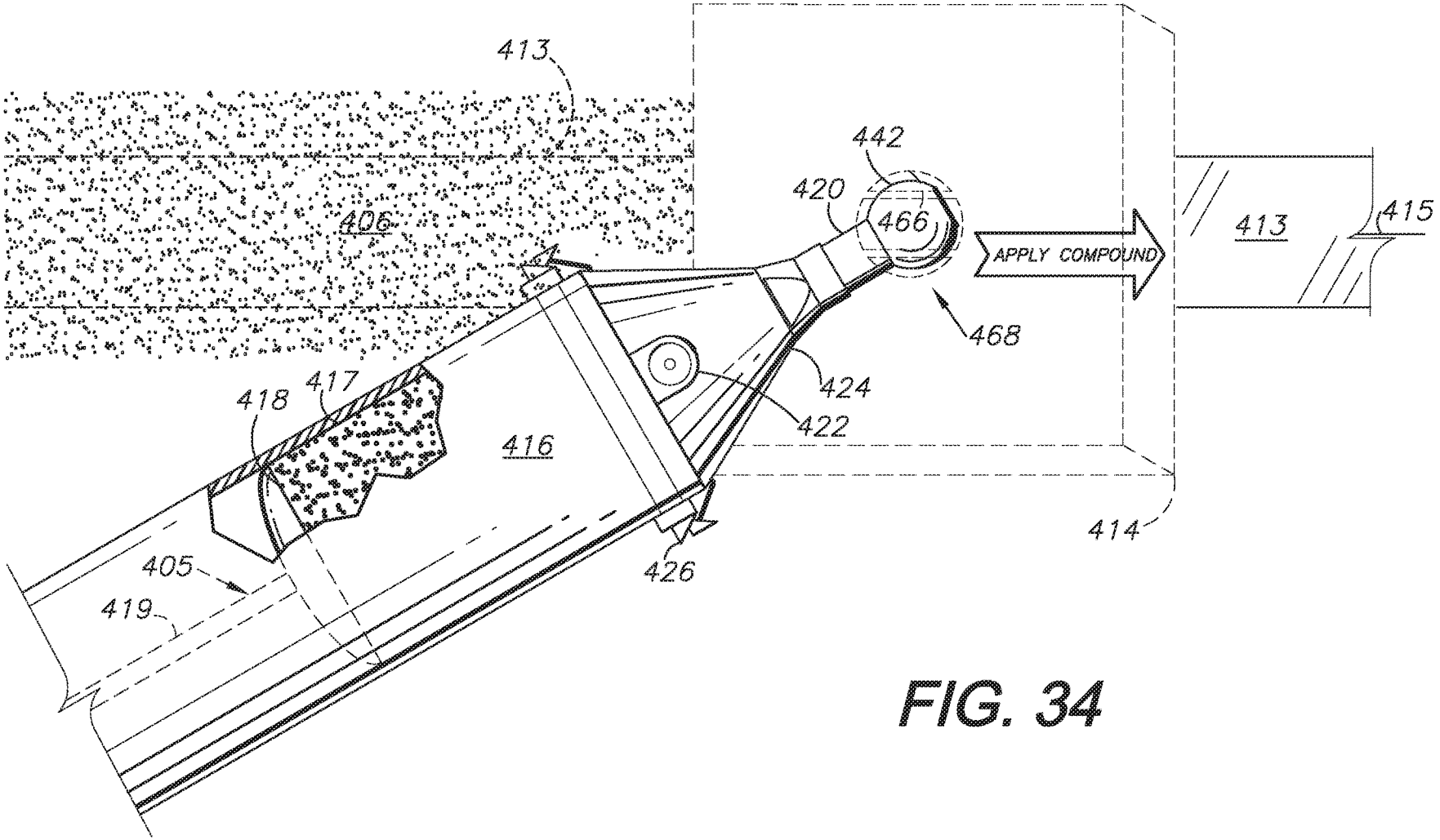
FIG. 34 is a fragmentary view of the alternative embodiment applicator, shown equipped with a flat surface attachment, shown applying compound to a wall joint.

A fifth modified embodiment or alternative aspect of the invention comprises a compound-applying system 402 including a push-to-dispense tool 404 with a quantity of finishing compound 406 in a hollow reservoir 416 including a bore 417. A linear actuator 405 includes a plunger 418 mounted on a connecting rod 419 and reciprocably received in the reservoir bore 417 for discharging the compound 406 through a distal, push-to-open valve assembly 420, to an angle head applicator 408 and then onto a work surface or surfaces. For example and without limitation, FIG. 28 shows the system 402 applying compound 406 to a horizontal, wall-ceiling joint 410 between a wall 407*a* and a ceiling 407*b* with the angle head applicator 408. FIG. 29 shows compound 406 being applied to a vertical, wall-wall joint 412 between walls 407*a*. FIG. 34 shows the system 402 with a flat head applicator 414, which is adapted for applying compound to a wall joint 415.

Typical gypsum board (also known as drywall) construction involves attaching the gypsum board sheets to the wall or ceiling structure, applying perforated, paper, joint tape 413 (FIG. 34) with a first coat of compound, applying perforated metal or plastic corner-protecting beads, and applying additional coats of compound. After drying and before recoating, each coat is typically sanded with special hand tools. Skilled workers can achieve relatively smooth, flat, planar results by applying a sufficient number of coats of compound and sanding each coat to a smooth surface finish. In the construction trades, drywall finishes are graded based on quality, with level five (5) being considered a top quality, commercial-grade finish, which is generally free of blemishes and imperfections.

The linear actuator 405 can comprise a gas piston-and-cylinder unit, a compressible spring unit or some other mechanism for advancing the plunger 418 through the reservoir 416. Alternative suitable linear actuators are described above. The reservoir 416 is refillable through an inlet (fill) port 422, which can be connected to a suitable pump for pumping the contents of a compound bucket into the reservoir 416 in a reloading or recharging operation. A generally conical dispensing head 424 is mounted on the distal end of the reservoir 416 by clamps 426, which permit field removal for cleaning, servicing, etc. The dispensing head 424 mounts the valve assembly 420.

Figure 30:
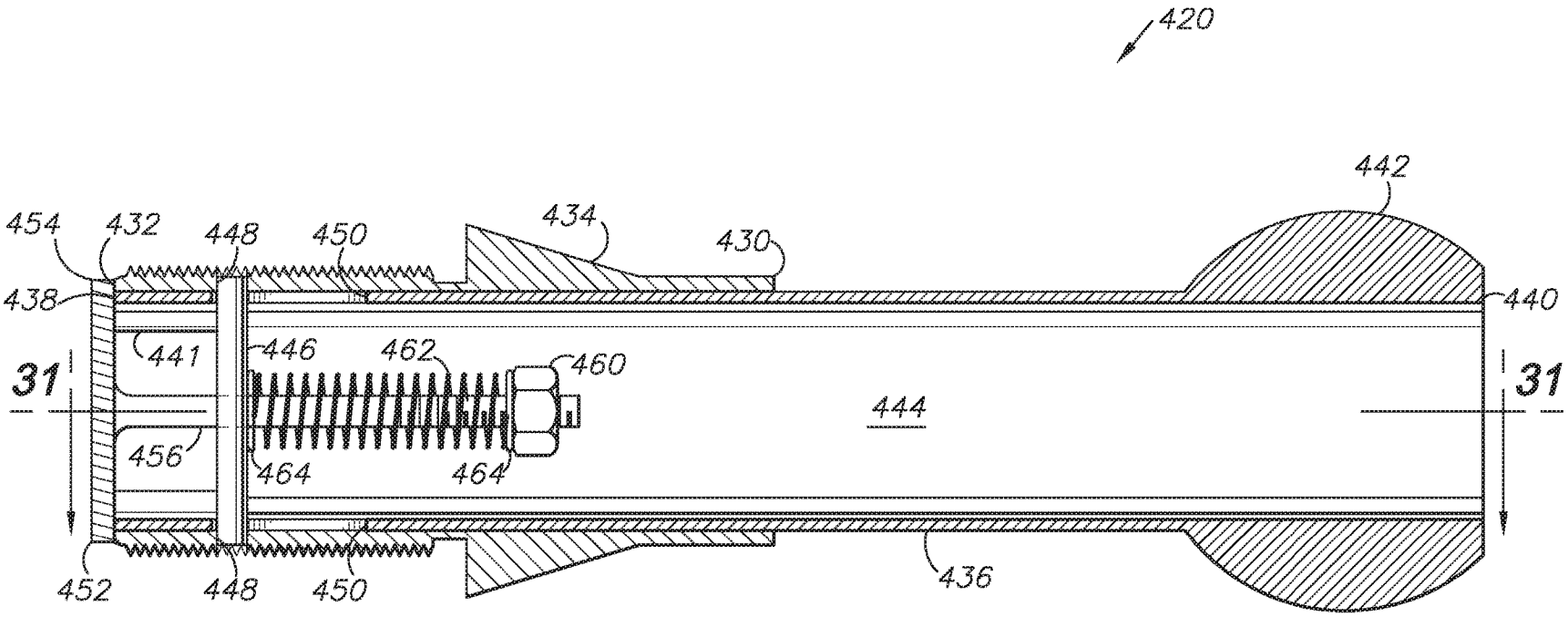
FIG. 30 is a cross-sectional view of a valve assembly of the modified, push-to-apply applicator, shown in a closed position.
Figure 31:
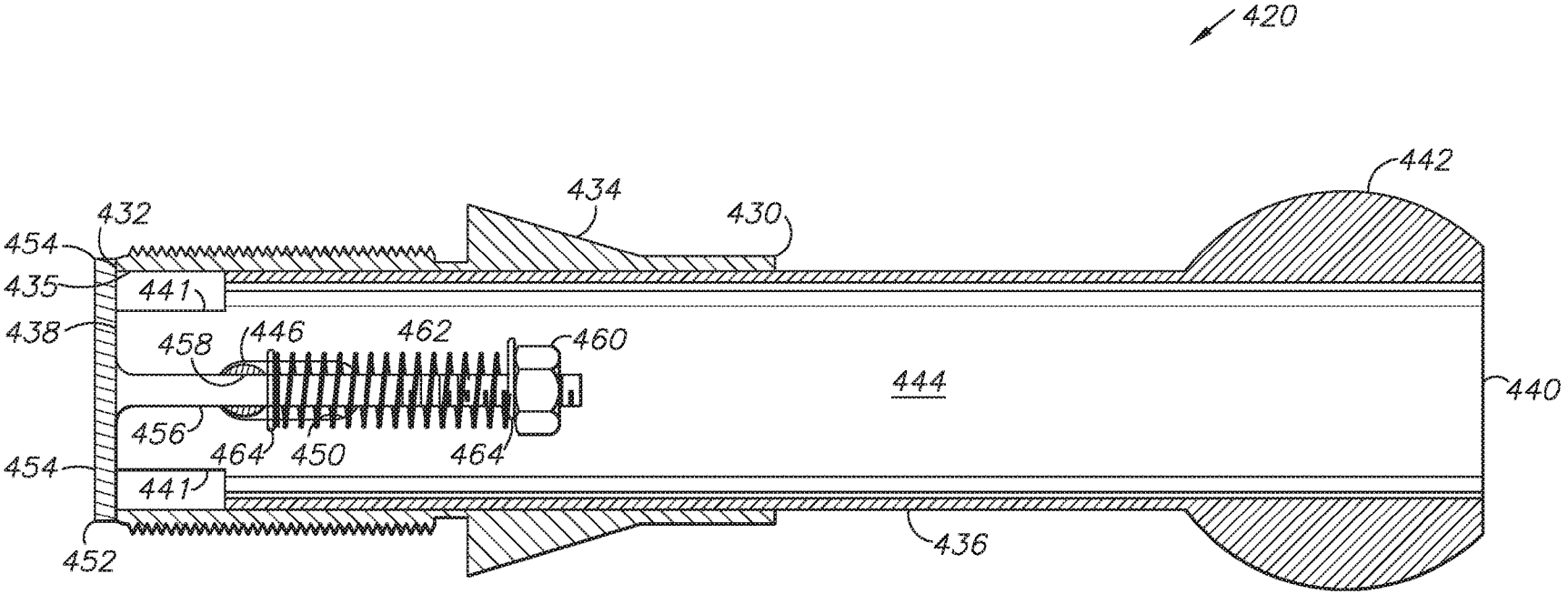
FIG. 31 is another cross-sectional view of the valve assembly in the closed position.
Figure 32:
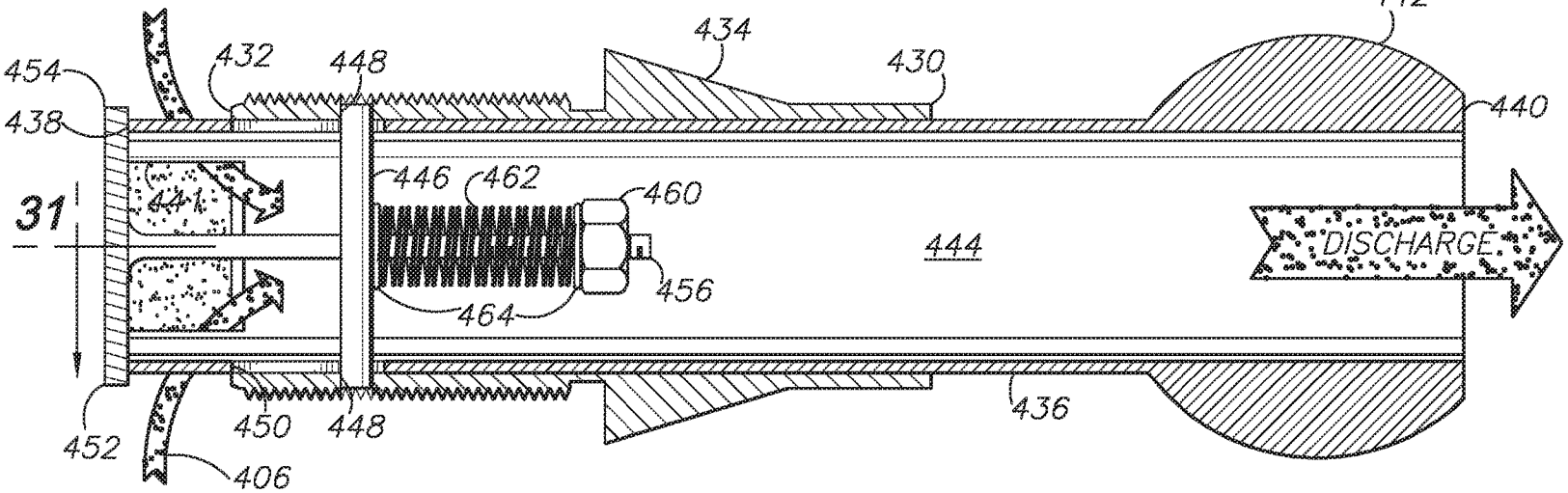
FIG. 32 is a cross-sectional view of the valve assembly in an open position.
Figure 33:
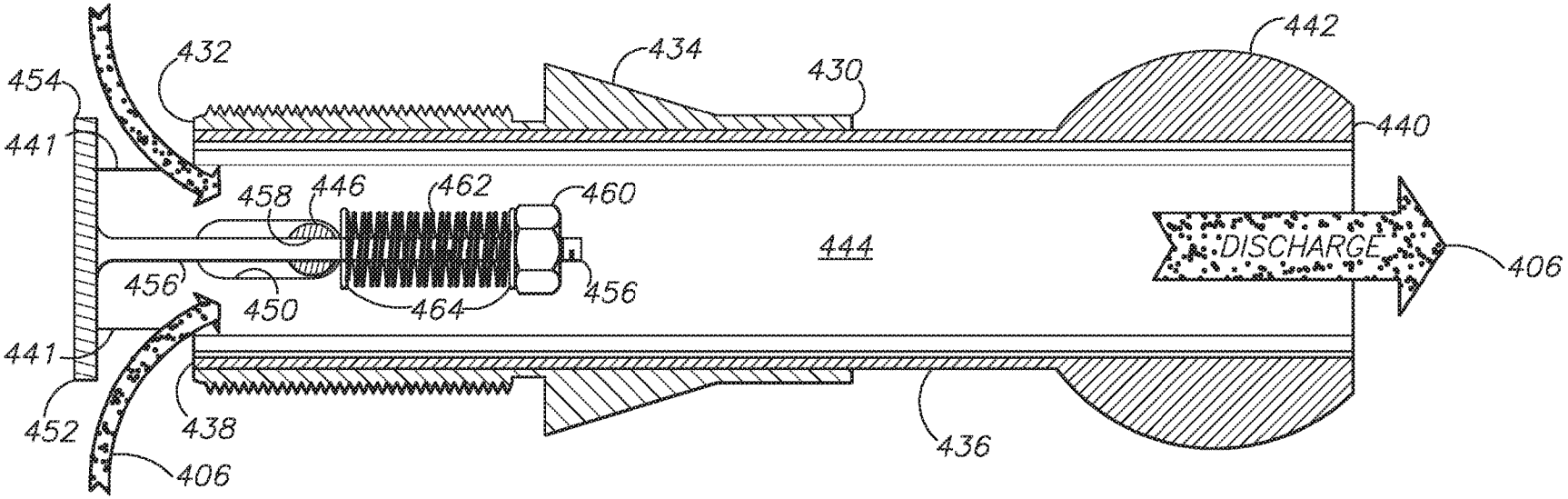
FIG. 33 is another cross-sectional view of the valve assembly in the open position.

FIGS. 30 and 31 show the push-to-open valve assembly 420 in a closed position. The valve assembly 420 includes an outer sleeve 430 with an externally-threaded proximal end 432, which screws into a distal end 428 of the dispensing head 424. The outer sleeve 430 also includes a tapered, distally-converging section 434 which generally aligns with the dispensing head 424. The valve assembly 420 also includes an inner sleeve 436 reciprocably, coaxially positioned within the outer sleeve 430 and movable relative thereto between the closed position (FIGS. 30, 31) and an open, compound-dispensing position (FIGS. 32, 33). The inner sleeve 436 includes a proximal end 438 and a distal end 440 with a partially spherical collar 442. The outer and inner sleeves 430, 436 include respective, coaxial bores 435, 444.

A valve guide pin 446 extends diametrically across the bore 444 and is secured at its ends in receivers 448 in the threaded, proximate end 432 of the outer sleeve 430. The guide pin 446 is slidably received in perspective guide slots 450 formed in the inner sleeve 436. A valve 452 includes a disc-shaped valve head 454 and a threaded valve shaft 456 extending coaxially therefrom through a valve shaft hole 458 formed in the middle of guide pin 446. The valve shaft 456 threadably receives a retaining nut 460. A helical compression spring 462 is compressed between the guide pin 446 and the retaining nut 460 with intermediate washers 464 at the ends of the compression spring 462.

The tool 404 is assembled by snapping the partially-spherical collar 442 into the socket 466 formed in the angle head and flat head applicators 408, 414. The resulting ball-and-socket connection between the collar 442 and the socket 466 provides a multi-axis, universal joint swivel connection, enabling the tool 404 to be positioned at various angles relative to the applicators 408, 414 and the joints 410, 412, 415 being finished.

The push-to-open operation of the valve assembly 420 accommodates relatively simple operation with minimal effort by an operator. More specifically, the compression spring 462 retains the valve 452 in a closed position with the valve head 454 engaging the outer sleeve proximal end 432, thus blocking the flow of compound 406 into the inner sleeve bore 444. Pushing the applicator 408, 414 against a surface pushes the inner sleeve 436 proximally into the reservoir bore 417 and compresses the return spring 462. Passages 441 in the inner sleeve 436 are thus exposed to the compound 406 in the reservoir 416. The compound 406, under pressure via the plunger 418, is forced through the inner sleeve bore 444 and is distributed onto the work surface by the applicator 408 or 414. Compound flow is halted by merely retracting the tool 404 from the work surface.

In addition to the simplified operation of the system 2 with the push-to-release feature described above, the system 402 accommodates efficient maintenance and cleaning. For example, the valve assembly 420 can readily be separated from the applicator 408 or 414 by un-snapping the ball-and-socket joint 468. The valve assembly 420 can then be unscrewed from the dispensing head 424. Unscrewing the nut 460 releases the valve member 452 and the return compression spring 462. The entire valve assembly 420 can be further disassembled by tapping the guide pin 446 through the receivers 448, thus releasing the outer and inner sleeves 430, 436. The separated parts can then be cleaned, maintained and replace as necessary. Other parts of the system 2 can likewise be efficiently disassembled, cleaned, maintained and replaced.

It is to be understood that while certain embodiments and/or aspects of the invention have been shown and described, the invention is not limited thereto and encompasses various other embodiments and aspects.

The invention claimed is:

1. A system for applying a finishing material to a work surface, which system includes:

a handle assembly including a hollow, tubular body with a proximal end, a distal end and a handle bore extending between said ends;

a material reservoir mounted on said handle assembly distal end, said reservoir including an interior configured for receiving a quantity of finishing material, an inlet to said interior and an outlet from said interior, said inlet and outlet respectively admitting and discharging material with respect to said reservoir interior;

a push-to-open valve assembly connected to said reservoir outlet and having a closed, extended position and an open, contracted position;

an applicator tool mounted on said handle assembly distal end and configured for receiving material from said valve assembly and applying material to a work surface; and said valve assembly being movable from said closed position to said open position by pushing said applicator against the work surface;

said handle assembly including a linear actuator mounted in said handle bore and movable between extended and retracted positions; and said linear actuator including a plunger in said material reservoir, said plunger configured for advancing said material through said reservoir and discharging said material through said outlet with said valve assembly in its open position.

2. The system according to claim 1, wherein said valve assembly includes:

a hollow sleeve with a proximal end in said material reservoir and a distal end at said handle assembly distal end; and a valve member reciprocably mounted in said sleeve and movable between: a closed position closing said sleeve proximal end with said valve assembly in its closed position; and an open position with said valve member spaced from said sleeve proximal end and admitting material from said reservoir into said sleeve.

3. The system according to claim 2, which includes:

said sleeve comprising an outer sleeve connected to said handle assembly and an inner sleeve reciprocably positioned in said outer sleeve;

said outer and inner sleeves each including: proximal and distal ends; and a sleeve bore extending between said sleeve ends;

said inner sleeve bore reciprocably receiving said valve member;

a valve return spring positioned coaxially in said inner sleeve and connected to said valve member; and said valve return spring having an expanded configuration biasing said valve member into sealing engagement with said sleeve proximal ends and a contracted position with said valve member in its open position spaced from said outer sleeve proximal end.

4. The system according to claim 3, which includes:

a valve guide pin mounted in and extending across said outer sleeve bore;

said valve guide pin including opposite ends each attached to said outer sleeve diametrically across said outer sleeve bore;

said guide pin including a hole coaxially aligned with said sleeves; and said valve member including: a valve stem coaxially aligned with said sleeves and reciprocably received in said guide pin hole; and a valve head coaxially mounted on said valve stem and configured for covering said outer sleeve proximal end with said valve member in its closed position.

5. The system according to claim 4, which includes:

a pair of guide pin slots formed in said inner collar;

each guide pin slot slidably receiving a respective guide pin end; and said guide pin slots configured for constraining motion of said valve member, between its open and closed positions.

6. The system according to claim 3, which includes:

said material reservoir including a dispensing head at its distal end;

said dispensing head including said material inlet;

said dispensing head including a threaded bore;

said outer sleeve including a threaded section adjacent to its proximate end and threadably received in said dispensing head threaded bore;

said inner sleeve distal end having a spherical collar coaxial with said inner sleeve bore; and said applicator tool including a socket receiving said spherical collar and forming a ball-and-socket, universal joint.

7. The system according to claim 3 wherein:

said inner sleeve includes a passage in proximity to said inner sleeve proximal end;

said outer sleeve closes said passage with said inner sleeve retracted in said outer sleeve in said valve assembly closed configuration; and said passage positioned in said material reservoir with said inner sleeve extended from said outer sleeve distal end in said valve assembly open configuration.

8. The system according to claim 1, wherein said linear actuator includes a gas cylinder unit configured for extending into said reservoir and discharging said material with said valve assembly in its open position.

9. The system according to claim 4, which includes:

said reservoir having a generally tubular configuration with a proximal end mounted on said handle distal end and a reservoir distal end mounting said valve assembly; and said reservoir including a bore reciprocably receiving said plunger.

10. The system according to claim 1, wherein said reservoir includes a fill access port in said dispensing head, said fill access port selectively admitting finishing material into said reservoir bore and retracting said plunger.

11. A system for applying a finishing material to a work surface, which system includes:

a handle assembly including a hollow, tubular body with a proximal end, a distal end and a handle bore extending between said ends;

said handle assembly including a linear actuator with an extendable-retractable member configured for retracting into said handle assembly and extending from said handle assembly distal end;

a material reservoir mounted on said handle assembly distal end, said reservoir including an interior configured for receiving a quantity of finishing material;

said material reservoir including an inlet to said interior and an outlet from said interior, said inlet and outlet respectively admitting and discharging material with respect to said reservoir interior;

a plunger in said material reservoir interior and connected to said linear actuator, said plunger configured for discharging said material through said outlet;

a push-to-open valve assembly connected to said reservoir outlet and having a closed, extended position and an open, contracted position;

said valve assembly including an outer sleeve connected to said handle assembly and an inner sleeve reciprocably positioned in said outer sleeve, said outer and inner sleeves each including: proximal and distal ends and a sleeve bore extending between said sleeve ends;

said valve assembly including a valve member reciprocably mounted in said inner sleeve bore and movable between: a closed position closing said outer sleeve proximal end with said valve assembly in its closed position and an open position with said valve member spaced from said outer sleeve proximal end and admitting material from said reservoir into said valve assembly, said valve assembly being movable from said closed position to said open position by pushing said applicator against the work surface; and an applicator tool mounted on said valve assembly and configured for receiving material from said valve assembly and applying material to a work surface.

12. The system according to claim 11, which includes:

a valve return spring positioned coaxially in said inner sleeve and connected to said valve member; and said valve return spring having an expanded configuration biasing said valve member into sealing engagement with said sleeve proximal ends and a contracted position with said valve member in its open position spaced from said outer sleeve proximal end.

13. The system according to claim 12, which includes:

a valve guide pin mounted in and extending across said outer sleeve bore;

said valve guide pin including opposite ends each received in said outer sleeve diametrically opposite each other;

said guide pin including an aperture coaxially aligned with said sleeves; and said valve member including: a valve stem coaxially aligned with said sleeves and reciprocably received in said guide pin aperture; and a valve head coaxially mounted on said valve stem and configured for covering said outer sleeve proximal end with said valve member in its closed position.

14. The system according to claim 13, which includes:

a pair of guide pin slots formed in said inner collar;

each guide pin slot slidably receiving a respective guide pin end; and said guide pin slots configured for constraining motion of said valve member, between its open and closed positions.

15. The system according to claim 11, which includes:

said dispensing head distal end including a threaded bore;

said outer sleeve including a threaded section adjacent to its proximal end and threadably received in said dispensing head threaded bore;

said inner sleeve distal end having a spherical collar coaxial with said inner sleeve bore; and said applicator tool including a socket receiver receiving said spherical collar and forming a ball-and-socket, universal joint.

16. The system according to claim 11, which includes:

said handle assembly including a linear actuator mounted in said handle bore and movable between extended and retracted positions; and said linear actuator including a plunger in said material reservoir, said plunger configured for advancing said material through said reservoir and discharging said material through said outlet with said valve in its open position.

17. The system according to claim 11, wherein said linear actuator includes a gas cylinder unit configured for extending and discharging said material with said valve in its open position.

18. The system according to claim 11 wherein said linear actuator includes a spring-powered unit configured for extending and discharging said material with said valve in its open position.

19. A system for applying a finishing material to a work surface, which system includes:

a handle assembly including a hollow, tubular body with a proximal end, a distal end and a handle bore extending between said ends;

said handle assembly including a linear actuator with an extendable-retractable member configured for retracting into said handle assembly and extending from said handle assembly distal end;

a material reservoir with a proximal end mounted on said handle assembly distal end, said reservoir including a coaxial bore configured for receiving a quantity of finishing material;

said material reservoir including a distal end and a dispensing head mounted on said reservoir distal end;

said dispensing head including a material inlet configured for admitting material into said reservoir bore;

said dispensing head including a coaxial bore configured for discharging material from said reservoir;

a plunger in said material reservoir interior and connected to said linear actuator, said plunger being extendable and retractable within said reservoir bore by said linear actuator;

a push-to-open valve assembly having a closed, extended position and an open, contracted position;

said valve assembly including an outer sleeve mounted on said dispensing head and an inner sleeve reciprocably positioned in said outer sleeve, said outer and inner sleeves each including: proximal and distal ends and a sleeve bore extending between said sleeve ends;

said inner sleeve including a passage in proximity to said inner sleeve proximal end;

said outer sleeve closing said passage with said inner sleeve retracted in said outer sleeve in said valve assembly closed configuration;

said passage positioned in said material reservoir with said inner sleeve extended from said outer sleeve distal end in said valve assembly open configuration;

said valve assembly including a valve member reciprocably mounted in said inner sleeve bore and movable between: a closed position closing said outer sleeve proximal end with said valve assembly in its closed position and an open position with said valve member spaced from said outer sleeve proximal end and admitting material from said reservoir into said valve assembly, said valve assembly being movable from said closed position to said open position by pushing said applicator against the work surface; and an applicator tool mounted on said valve assembly and configured for receiving material from said valve assembly and applying material to a work surface; and said applicator tool including a socket receiving said spherical collar and forming a ball-and-socket, universal joint.

* * * * *